US007191572B2

(12) United States Patent
Izquierdo

(10) Patent No.: US 7,191,572 B2
(45) Date of Patent: Mar. 20, 2007

(54) CONSTRUCTION METHOD AND SYSTEM

(76) Inventor: Luis W. Izquierdo, Isidora Goyenechea N° 3356 Office N° 41, Las Condes, Santiage (CL)

( * ) Notice: Subject to any disclaimer, the term of this patent is extended or adjusted under 35 U.S.C. 154(b) by 0 days.

(21) Appl. No.: 10/100,026

(22) Filed: Mar. 19, 2002

(65) Prior Publication Data

US 2003/0177733 A1 Sep. 25, 2003

(51) Int. Cl.
*E04B 5/04* (2006.01)

(52) U.S. Cl. ..... 52/699

(58) Field of Classification Search ..... 52/425, 52/426, 427, 428, 431, 699; 249/40, 44, 249/47, 33, 192, 191, 190
See application file for complete search history.

(56) References Cited

U.S. PATENT DOCUMENTS

| | | | | | |
|---|---|---|---|---|---|
| 839,021 | A | | 12/1906 | McCarthy | 249/43 |
| 1,162,554 | A | | 11/1915 | Berry | |
| RE16,793 | E | | 11/1927 | Smith | 44/69 |
| 1,735,017 | A | | 11/1929 | Smith | 249/216 |
| 1,907,618 | A | | 5/1933 | Umbach et al. | 249/217 |
| 2,099,260 | A | | 11/1937 | Colt | 25/131 |
| 2,160,489 | A | | 5/1939 | Spies | 44/69 |
| 2,709,292 | A | * | 5/1955 | Otti | 249/43 |
| 3,197,171 | A | | 7/1965 | Michalak | 249/40 |
| 3,199,827 | A | | 8/1965 | Terry | 249/41 |
| 3,263,956 | A | | 8/1966 | Hawkins | 249/40 |
| 3,288,428 | A | | 11/1966 | Terry | 249/214 |
| 3,415,484 | A | | 12/1968 | Klaiss | 249/216 |
| 3,751,867 | A | * | 8/1973 | Layne | 52/426 |
| 4,409,764 | A | * | 10/1983 | Wilnau | 52/127.3 |
| 4,669,234 | A | * | 6/1987 | Wilnau | 52/98 |
| 4,901,494 | A | | 2/1990 | Miller et al. | 52/309.12 |
| 4,936,540 | A | | 6/1990 | Boeshart | 249/216 |
| 5,140,794 | A | | 8/1992 | Miller | 52/309.12 |
| 5,209,039 | A | | 5/1993 | Boeshart | 52/699 |
| 5,216,860 | A | * | 6/1993 | Thomson et al. | 52/259 |

(Continued)

OTHER PUBLICATIONS

Merriam-Webster Dictionary, http://www.meriamwebster.com, pp. 2.*

*Primary Examiner*—A. Joseph Wujciak, III
(74) *Attorney, Agent, or Firm*—Birch, Stewart, Kolasch & Birch, LLP

(57) ABSTRACT

A system for reinforced concrete construction, which relates the bar mat with the molding panels so as to obtain a rigid assembly capable of resisting the pressure of the placed concrete. The system integrates concrete's reinforcement and formwork, thereby making a rigid reinforcement web permitting direct attachment of the molding panels on it, holding them from the inside and avoiding the heavy external structure commonly used to stiffen the forms. This rigid assembly may be obtained by welded joints in the reinforcement web, and, or, using specially designed bar support devices such as tie and spacer units, intended to set in place both reinforcement and sheathing. Thus, the embodiment of the proposed system requires a method of assembly, which considers a combination of standard and invented elements. The latter are reinforcement welded mats and joists, and elements as ties, spacers, washer plates and sleeves for interlocking the bar mat and the molding panels together. The embodiment considers as well the use of standard elements, such as deformed reinforcement steel bars, and plywood or similar molding sheathing. The proposed system is intended for the construction of walls, columns, beams, slabs or any building member in cast-in-place reinforced concrete.

14 Claims, 30 Drawing Sheets

STEP 3

U.S. PATENT DOCUMENTS 5,332,189 A 7/1994 Tseng ..... 249/40
5,431,368 A * 7/1995 Wilde ..... 249/213
5,497,592 A * 3/1996 Boeshart ..... 52/699
5,704,180 A 1/1998 Boeck ..... 52/426
5,836,126 A 11/1998 Harkenrider et al. ..... 52/410
5,852,907 A * 12/1998 Tobin et al. ..... 52/714
5,922,236 A * 7/1999 Zuhl ..... 249/34
6,231,025 B1 * 5/2001 Takemura ..... 249/40

* cited by examiner

STEP 1

STEP 2

STEP 3

STEP 4

STEP 1

STEP 4

STEP 1

STEP 2

STEP 3

STEP 4

STEP 5

STEP 6

STEP 7

STEP 8

STEP 1

STEP 2

STEP 3

STEP 4

STEP 5

STEP 6

STEP 1

STEP 2

STEP 3

STEP 4

STEP 5

STEP 6

STEP 7

STEP 8

STEP 1

STEP 2

STEP 3

STEP 4

STEP 5

STEP 6

WALL LENGTH

| WALL SECTION | 60 | 80 | 100 | 120 | 140 | 160 | 180 | 200 | 220 | 240 | 260 | 280 | 300 | 320 | 340 | 360 | 380 | 400 | 420 | 440 | 460 | 480 | 500 | 520 | 540 | 560 | 580 | 600 |
|---|---|---|---|---|---|---|---|---|---|---|---|---|---|---|---|---|---|---|---|---|---|---|---|---|---|---|---|---|
| 15,0 | | | | | | | | | | | | | | | | | | | | | | | | | | | | |
| 17,5 | | | | | | | | | | | | | | | | | | | | | | | | | | | | |
| 20,0 | | | | | | | | | | | | | | | | | | | | | | | | | | | | |
| 22,5 | | | | | | | | | | | | | | | | | | | | | | | | | | | | |
| 25,0 | | | | | | | | | | | | | | | | | | | | | | | | | | | | |

JOISTS STANDARD MEASURES TABLE

CONSTRUCTION METHOD AND SYSTEM

BACKGROUND OF THE INVENTION

1. Field of the Invention

The present invention relates to a system and method of reinforced concrete construction, and more particularly to a system and method setting a reinforcement bar mat and molding forms, and interlocking these components by specially designed devices to obtain a rigid assemblage capable of containing the poured concrete with precision alignment.

2. Description of the Background Art

Conventionally, in the case of walls or pillars, the method for cast-in-place concrete construction considers at first the setting of the reinforcement. The reinforcement is typically composed of a plurality of bars and/or welded wire fabrics, with the minimum ties and spacers needed to hold them momentarily in place. Then, the formwork is positioned concealing the reinforcement web, but using independent structural supports to externally brace the sheathing, such as studs, walers and braces, required to resist the pressure of the cementious mixture that is to be placed afterwards.

Finally, when the concrete has hardened, the formwork is removed. In the case of slabs, the usual procedure is to begin with the scaffolding that supports beams and panels. Over them the sheathing and the reinforcement web are laid. Then the concrete mix is placed, and when it has hardened, the forms and scaffoldings are removed.

Although nowadays it is customary that parts of the structural reinforcement network for concrete are prefabricated, and there is a wide stock of welded wire fabrics and several welded reinforcement cages for beams and pillars, either standard or custom made, these elements are not intended, nor specially designed, for also holding the forms. Otherwise, many kinds of ties and spacers for holding molding panels from the inside of the building member are available that are meant to remain imbedded in the concrete. However, they are not conceived as the same structurally needed reinforcement for concrete. Therefore, the existing methods for reinforced concrete construction do not structurally relate the reinforcement and the formwork.

The following related previous patents were found which disclose systems for forming reinforced concrete walls wherein the wall forms are spaced by elements that also serve to tie the forms together and include formations for receiving the reinforcement rods that are embedded in the finished wall. Specifically, U.S. Pat. No. 1,162,554 to Berry; U.S. Pat. No. 2,099,260 to Colt; U.S. Pat. No. 2,160,489 to Spies; U.S. Pat. No. 4,936,540 to Boeshart; U.S. Pat. No. 5,209,039 to Boeshart; U.S. Pat. No. 5,704,180 to Boeck; and U.S. Pat. No. 5,852,907 to Tobin et al. describe systems of the background art, the entirety of each of which are hereby incorporated by reference. However, none of these systems of the background art uses the same structural reinforcement rigidly interlocked with the molds. Therefore an integrated, comprehensive system suitable for building walls, slabs and any similar form in cast-in-place concrete has heretofore not been available in the related art.

SUMMARY OF THE INVENTION

The present invention overcomes the shortcomings associated with the background art and achieves other advantages not realized by the background art.

An object of the present invention is to provide an improved system for cast-in-place concrete construction that can be carried out using specific hardware in order to stiffen the reinforcement so as to permit the direct attachment of molding panels on the reinforcement. The molding panels are held from the inside and thus the present invention avoids the heavy external bracing commonly used to structure the forms in the background art.

An object of the present invention is to provide an improved system for cast-in-place concrete construction that results in lighter, frameless forms and faster reinforcement and sheathing installation.

An additional object of the present invention is to provide an improved system for cast-in-place concrete construction that results in faster mold removal, precise positioning of reinforcements, and precision alignment of formworks.

An additional object of the present invention is to provide an improved system for cast-in-place concrete construction that results in accurate control of surface finishes and job site space savings and cleaner work.

An additional object of the present invention is to provide an improved system for cast-in-place concrete construction that results in reinforcement and formwork are coordinated and may be prefabricated, and time and cost savings in reinforcement and formwork installation.

These and other objects are further accomplished by a method and a system for concrete construction that interlocks the reinforcement web and the molding boards as to obtain a rigid assembly capable of supporting the bar mat and resisting the pressure of the placed concrete, keeping precise alignment. This system is suitable for the construction in cast-in-place reinforced concrete of any of the building members, such as walls, columns, beams and slabs. In accordance with the preferred embodiments, the system is carried out by means of a set of specially designed devices, which elements are applicable depending on the different ways the reinforcement can be assembled in place.

A rigid reinforcement bar net is obtained by (i) A prefabricated three-dimensional welded bar mat, comprised by either standard elements for typical sizes of walls, pillars, beams and slabs, or specially designed to meet the requirements of particular projects; ii) A three-dimensional reinforcement web composed by prefabricated parts, which are substantially two-dimensional elements, namely joists, assembled in place with single bars by means of connection devices that also hold the sheathing, forming a rigid structural whole; and/or iii) A three-dimensional non-welded bar mat comprised by substantially linear elements, namely straight or bent single bars, assembled in place by means of connection devices which interlock them with the sheathing, forming a rigid structural whole.

The three-dimensional bar mats are basically formed by a double reinforcement curtain, where the curtains at each face of the wall or slab member are interlocked between them and with the sheathing. These basic reinforcement webs may support as well additional bars needed to meet specific structural design conditions. All the bars, including the rods and webs that interlock curtain grids and remain embedded in the concrete, should be properly considered in resistance calculations as structural members, and therefore, should not represent useless extra structural reinforcement.

The proposed system allows that the molding boards may be easily removed after the concrete has hardened, or if desired, left in place as insulation or finishing veneer, depending on the particular requirements for each case.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

The present invention will hereinafter be described with reference to the accompanying drawings. The technical terms used herein should be understood in accordance with the "Cement and Concrete Terminology" reported by the American Concrete Institute.

FIGS. 1–4 are isometric views corresponding to the STEPS 1–4, respectively, in a building sequence of a typical wall member using a prefabricated three-dimensional welded reinforcement framework, standard molding boards and a set of nuts and washer plates according to an embodiment of the present invention. FIGS. 1–4 illustrate a building sequence shown in 4 steps, through FIGS. 1 to 4, of a typical wall member, corresponding to a prefabricated three-dimensional welded reinforcement framework (namely, a cage) assembled to standard molding boards preferably by means of a set nuts and washer plates, as further detailed in FIG. 35.

Figure 1:
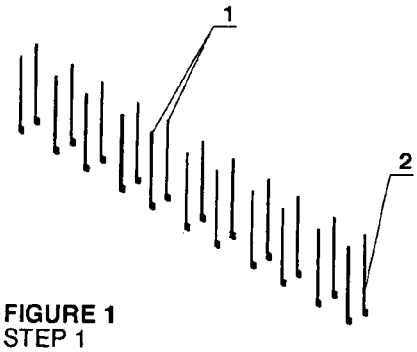
FIGS. 1–4 are isometric views corresponding to the STEPS 1–4, respectively, in a building sequence of a typical wall member using a prefabricated three-dimensional welded reinforcement framework, standard molding boards and a set of nuts and washer plates according to an embodiment of the present invention.
Figure 2:
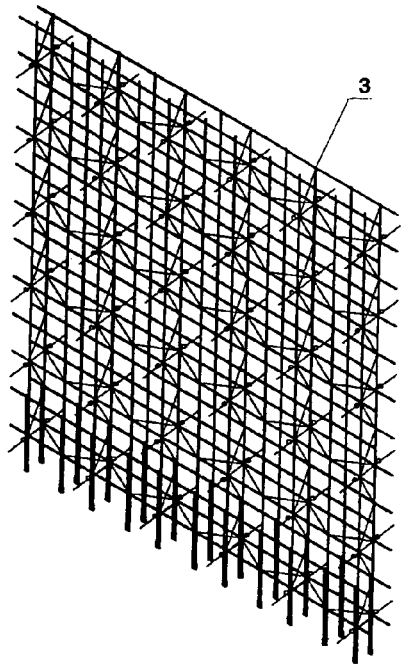
Figure 50:
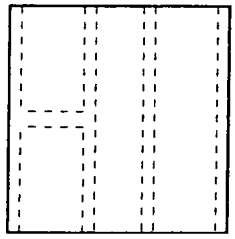
FIGS. 50–52 are plan views and an isometric view of an injected plastic sleeve for connecting overlapped bars. The spacer is to be used in the building sequence shown in FIGS. 7–20 and the sleeve is applicable for any of the building sequences of the present invention.
Figure 52:
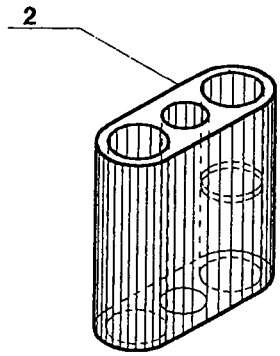
Figure 51:
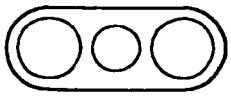

FIG. 1 designates an initial stage with overlapped stem bars (1) vertical outset sprouting from a floor slab, a footing or a lower wall member, aligned as to receive the cage preferably fitted in specially designed plastic sleeves (2), which are further detailed in FIGS. 50, 51 and 52. FIG. 2 corresponds to the setting of the framework, which consists in a three-dimensional rigid structure substantially formed by some or all of the required concrete's reinforcement bars. The preferred arrangement shown is a prefabricated cage (3) formed by a typical double curtain made of welded-wire fabrics which are inter-connected by welded wire ties and diagonal webs. Extra bars may be added attached to the cage with common wire or plastic ties, according to specific structural design.

Figure 3:
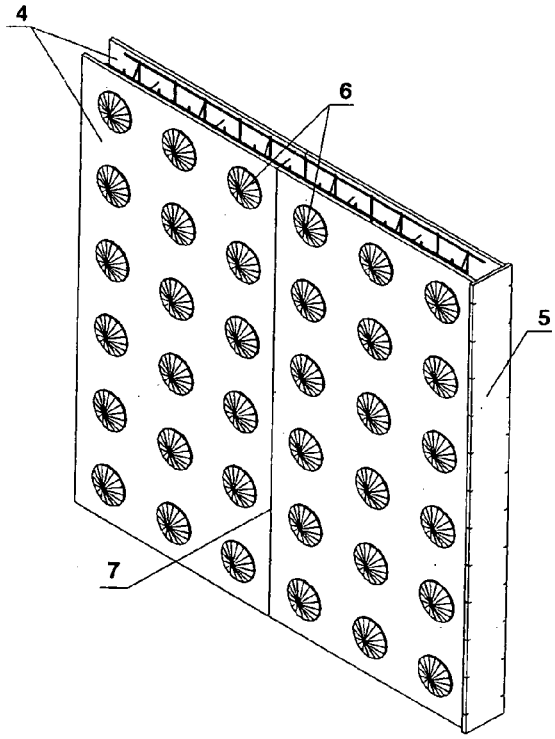

FIG. 3 corresponds to the setting of molding sheathing (sides (4) and bulkhead panel (5)). These panels may be of plywood (typical ¾" thick shown), wood particles, or other materials, as metals or plastics (such as transparent acrylic for seeing through or polyurethane, to be left in place for insulation). The panels are perforated with bores that match the ties in the cage, to let them pass through as fasteners. The preferred solution in order to fasten the molds to the cage considers wire ties with threaded tips secured by nuts and washer plates (6), for stress distribution on the panels, although other means, such as clamps or brackets with studs and walers may be used for the same purpose. The design of the washer plates is detailed in FIGS. 57 and 58. Preferably, a continues strip seal (7) is to be placed between the joints as a gasket to prevent leakage of the forms. Several alternative joint seal strips in combination with square cut edges or other sheathing siding patterns, to be used depending on the desired concrete surface finishing, are further detailed in FIGS. 59, 60, 61 and 62. Preferably, the bulkhead panel has a pair of grooves into which the side panels edges are inserted to assure proper alignment and seal, and saw-cut slots at both sides to let tensioned strap fasteners, as further detailed in FIG. 41.

Figure 4:
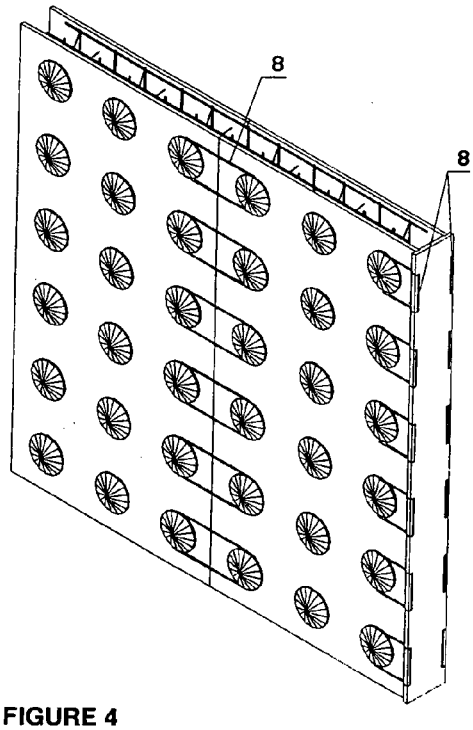

FIG. 4 designates the final stage of the three-dimensional reinforcement formwork and molding assembly of a wall, ready for concrete placement. The preferred embodiment shown considers tensioned straps (8) belted on the washer plates to tighten the assemblage of panels for accurately sealing its joints.

Figure 5:
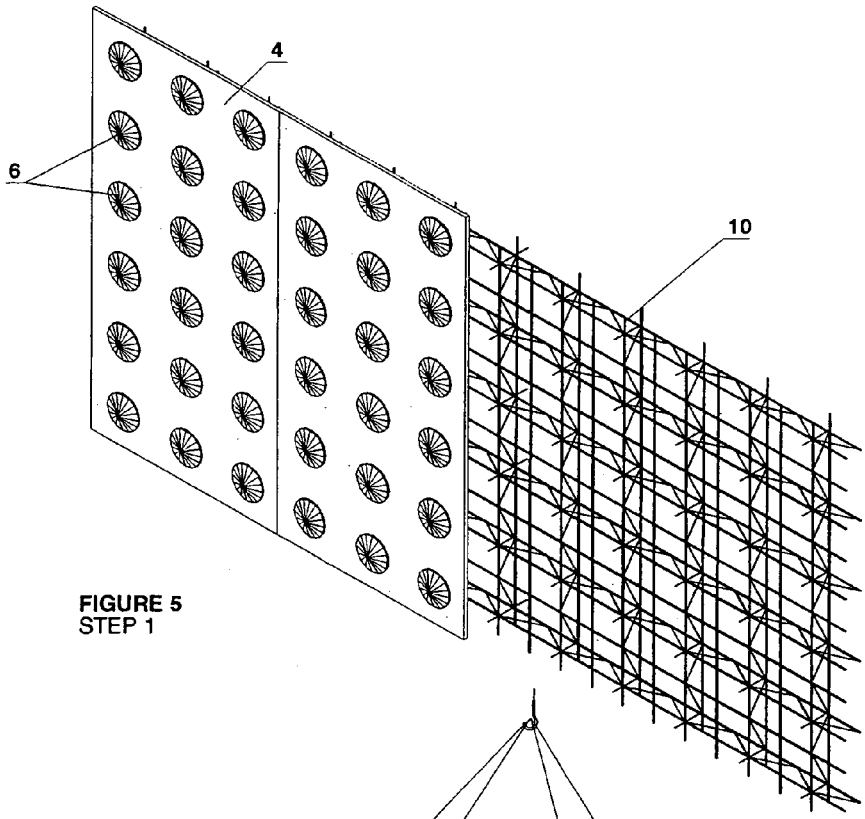
FIGS. 5–6 are isometric views corresponding to the STEPS 1–2, respectively, in a building sequence of a typical slab member using a prefabricated three-dimensional welded reinforcement framework, standard molding boards and a set of nuts and washer plates according to an embodiment of the present invention.
Figure 6:
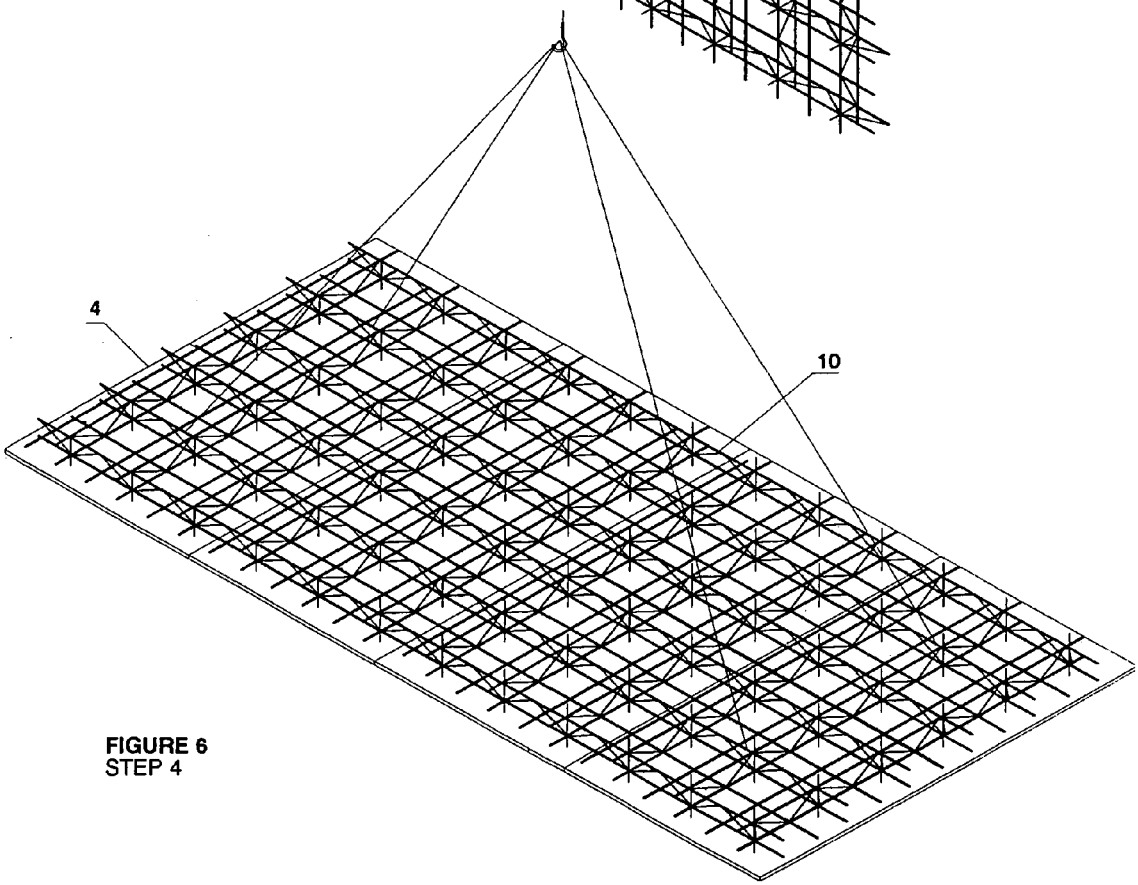

FIGS. 5–6 are isometric views corresponding to the STEPS 1–2, respectively, in a building sequence of a typical slab member using a prefabricated three-dimensional welded reinforcement framework, standard molding boards and a set of nuts and washer plates according to an embodiment of the present invention. FIGS. 5–6 illustrate a building sequence shown in two steps, through FIGS. 5 to 6, of a typical slab member, corresponding to a prefabricated cage assembled to standard molding boards by means of a set of nuts and washer plates, as further detailed in FIG. 36.

FIG. 5 designates an initial stage, where the molding panels (4) are set as in the case before referred to wall members in FIG. 3, but only on one side of the reinforcement cage (10), which is momentarily hold in vertical position (or if preferred, horizontally up side down) to allow convenient access for placing them. The preferred arrangement shown is a prefabricated cage (10) formed by some or all of the concrete's reinforcement bars, with a double curtain reinforcement made of welded wire fabrics that are inter-connected by welded diagonal wire webs and welded wire.

FIG. 6 designates the final stage of the cage and molding assembly for a slab, in which it is tilted and placed in horizontal position with the sheathing's face downwards, and then lifted and putted on scaffolding for pouring concrete in place. Extra reinforcement bars may be added at this stage, if needed according to structural design.

Figure 38:
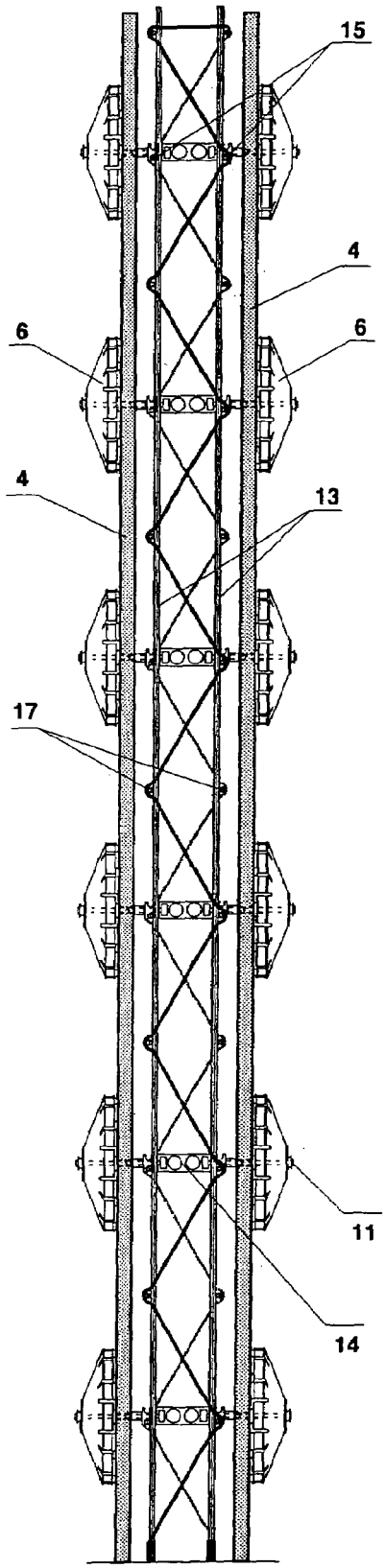
FIG. 38 is a side view corresponding to a horizontal section of wall members showing reinforcement with welded bar joists, standard molding boards and connection devices according to an embodiment of the present invention.
Figure 39:
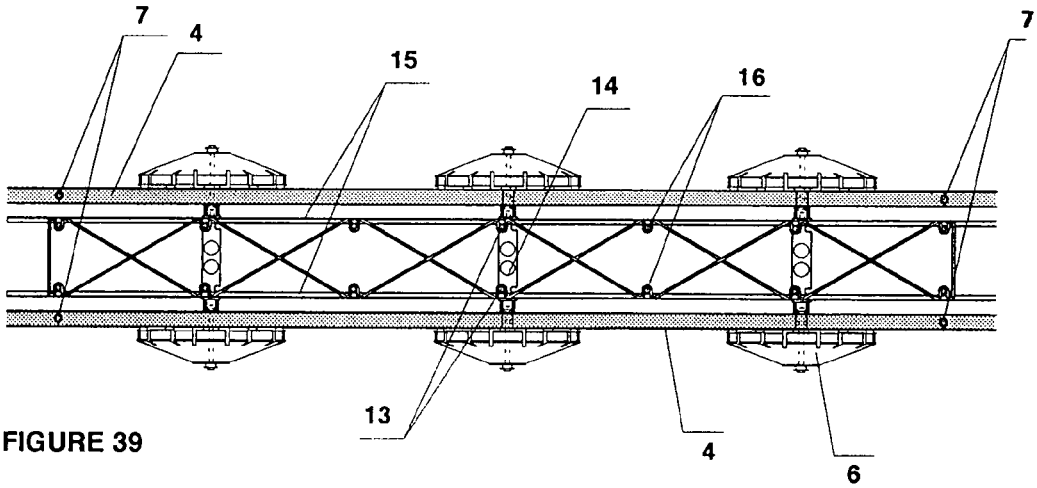
FIG. 39 is a side view corresponding to a horizontal section of wall members showing reinforcement with welded bar joists, standard molding boards and connection devices according to an embodiment of the present invention.

FIGS. 7–10 are isometric views corresponding to STEPS 1–4, respectively, in a building sequence of a typical wall member using two-dimensional welded reinforcement elements in combination with straight bars, standard molding boards and a set of specially designed connection devices according to an embodiment of the present invention. FIGS. 11–14 are isometric views corresponding to STEPS 5–8, respectively, in a building sequence of a typical wall member using two-dimensional welded reinforcement elements in combination with straight bars, standard molding boards and a set of specially designed connection devices according to an embodiment of the present invention. FIGS. 7–14 illustrate a building sequence shown in eight steps, through FIGS. 7 to 14, of a typical wall member, using a reinforcement framework formed by the assembly of prefabricated substantially two-dimensional welded wire elements, namely joists, and single bars with standard molding boards, by means of specially designed connection devices, such as spacers, sleeves, washer plates and joint seal strips. The assembly of the elements is shown in FIGS. 38 and 39, and in further detail in FIGS. 40 and 41. The joists are detailed in FIGS. 44 and 45. The sleeves are detailed in FIGS. 50, 51 and 52, and the washers are detailed in FIGS. 57 and 58, and the joint seals are detailed in FIGS. 59, 60, 61 and 62.

Figure 7:
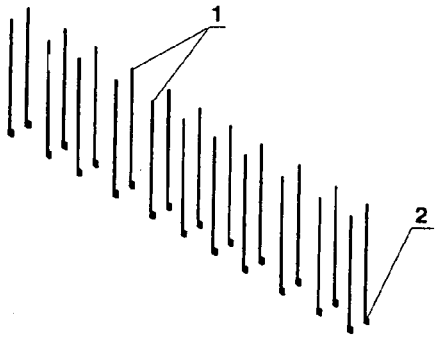
FIGS. 7–10 are isometric views corresponding to STEPS 1–4, respectively, in a building sequence of a typical wall member using two-dimensional welded reinforcement elements in combination with straight bars, standard molding boards and a set of specially designed connection devices according to an embodiment of the present invention.
Figure 8:
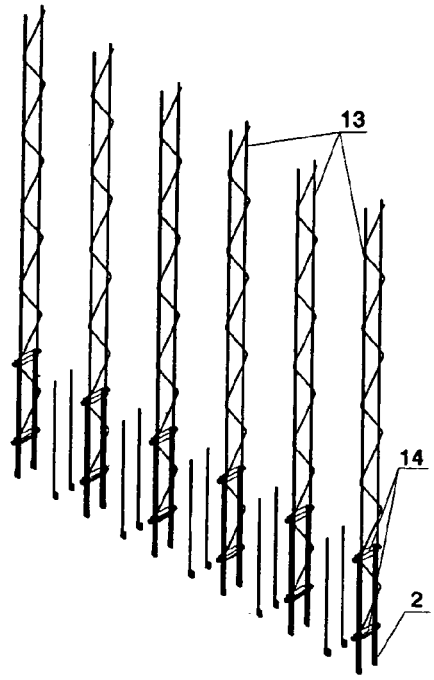

FIG. 7 designates an initial stage with the overlapped stem bars (1) vertical outset sprouting from a floor slab, a footing or a lower wall member, aligned as to receive the reinforcement framework preferably fitted in the specially designed plastic sleeves (2). FIG. 8 corresponds to step 2, with the setting of the vertical reinforcement joists (13). Each of these is preferably fixed to the stem bars by means of a pair of the spacers (14) and the sleeves (2).

Figure 9:
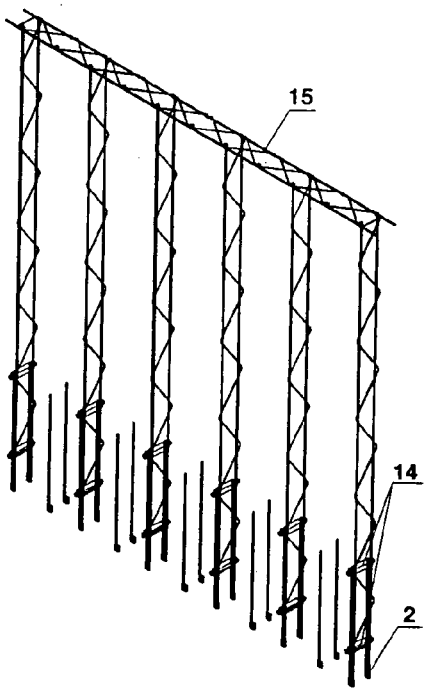
Figure 10:
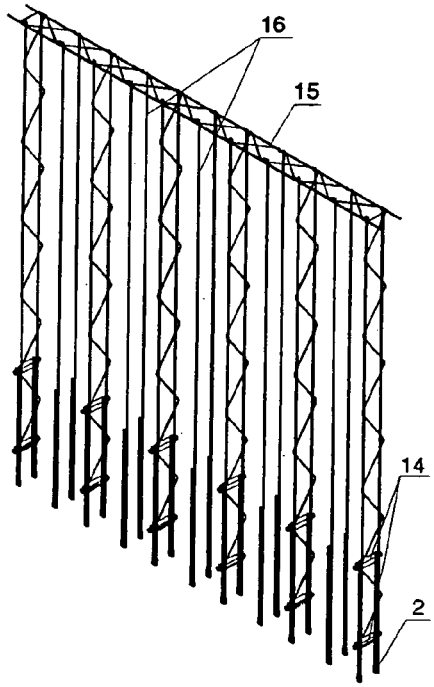

FIG. 9 corresponds to step 3, with the setting of an upper horizontal reinforcement joist (15), intended to properly aligning and stiffen that direction of the entire assemblage. The joist is preferably as detailed in FIG. 45. FIG. 10 corresponds to step 4, with the setting of the single vertical bars (16) that form part of a typical double curtain reinforcement. These bars are preferably fixed inserted downwards in the sleeves and upwards, adjusted in openings let by the wire webs of the horizontal joists.

Figure 11:
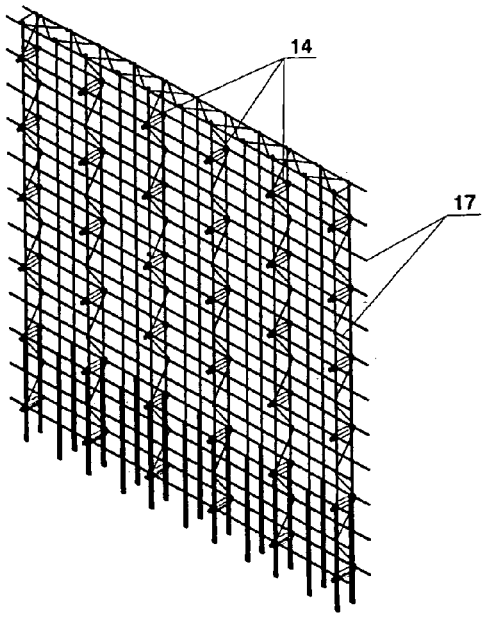
FIGS. 11–14 are isometric views corresponding to STEPS 5–8, respectively, in a building sequence of a typical wall member using two-dimensional welded reinforcement elements in combination with straight bars, standard molding boards and a set of specially designed connection devices according to an embodiment of the present invention.

FIG. 11 corresponds to step 5, with the setting of single horizontal bars (17) and the plastic spacers (14). The horizontal bars are introduced into the aligned openings let by the wire webs of each of the vertical joists, to complete the typical double curtain reinforcement. Then, the spacers (14) are set in place pressing the bars so as to get griped into their matching slots at the intersection of the stringers of the vertical reinforcement joists with the horizontal bars. The preferred distance between the units of spacers, ties and washers is equal to that of two spaces between bars of the reinforcement curtain, but the distance may vary coordinated with the reinforcement bar distribution and with the stiffness of the formwork, depending on the pressure caused upon the forms by the placement of the fresh concrete.

Figure 12:
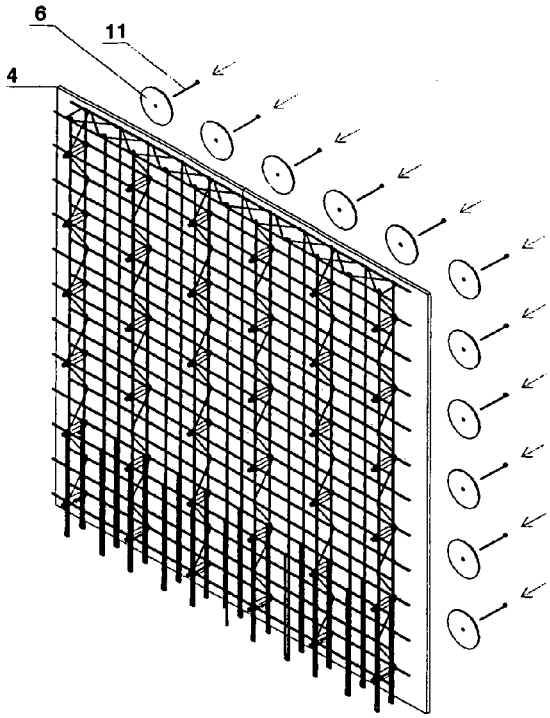

FIG. 12 corresponds to step 6, with the setting of the back sheathing (4), usually formed by ¾" thick plywood or similar boards. The boards are perforated with bores of the same diameter of the tie bolts that match the spacer distribution in the reinforcement bar mat. The tie bolts (11) are introduced across the washer plates (6), the panels and the corresponding bores in the spacers already located in the bar mat.

Figure 13:
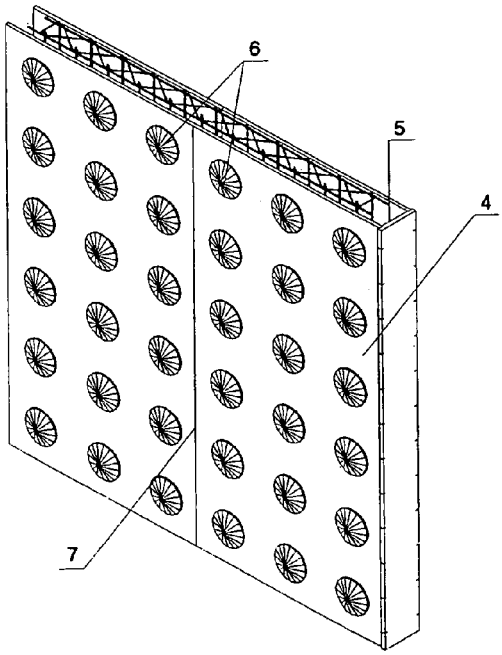

FIG. 13 corresponds to step 7, with the setting of the frontal sheathing (4) and bulkhead mold (5), also usually formed by ¾" thick plywood or similar boards. The frontal boards (4) are, as the back panels, also perforated with bores of the same diameter of the tie bolts, which correspond to the spacer distribution in the bar mat. The tie bolts already passed through the spacers are introduced across the matching bores in the boards and washer plates (6) and are secured preferably by wing-nuts. The preferred bulkhead panel (5) is similar to that referred before describing FIG. 3. Joint seal strips (7) are preferably placed between molding panels to prevent leakage, as already described in reference to FIG. 3.

Figure 14:
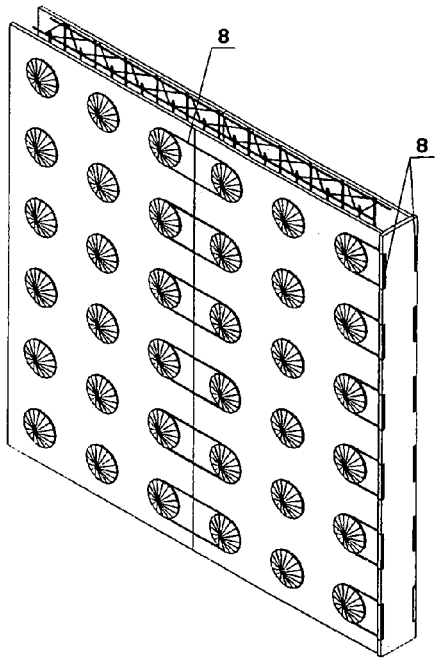

FIG. 14 designates the final stage of the building sequence of a wall with a reinforcement net formed by welded bar joists and single bars. As in the case before illustrated in FIG. 4, the preferred embodiment shown considers standard tensioned straps (8) belted on the washer plates to tighten the paneling assemblage for accurately sealing joints.

Figure 15:
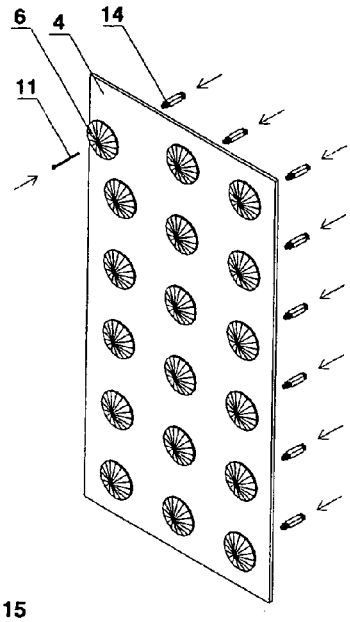
FIGS. 15–16 are isometric views corresponding to STEPS 1–2, respectively, in a building sequence of a typical slab member using two-dimensional welded reinforcement elements in combination with straight bars, standard molding boards and a set of specially designed connection devices according to an embodiment of the present invention.
Figure 16:
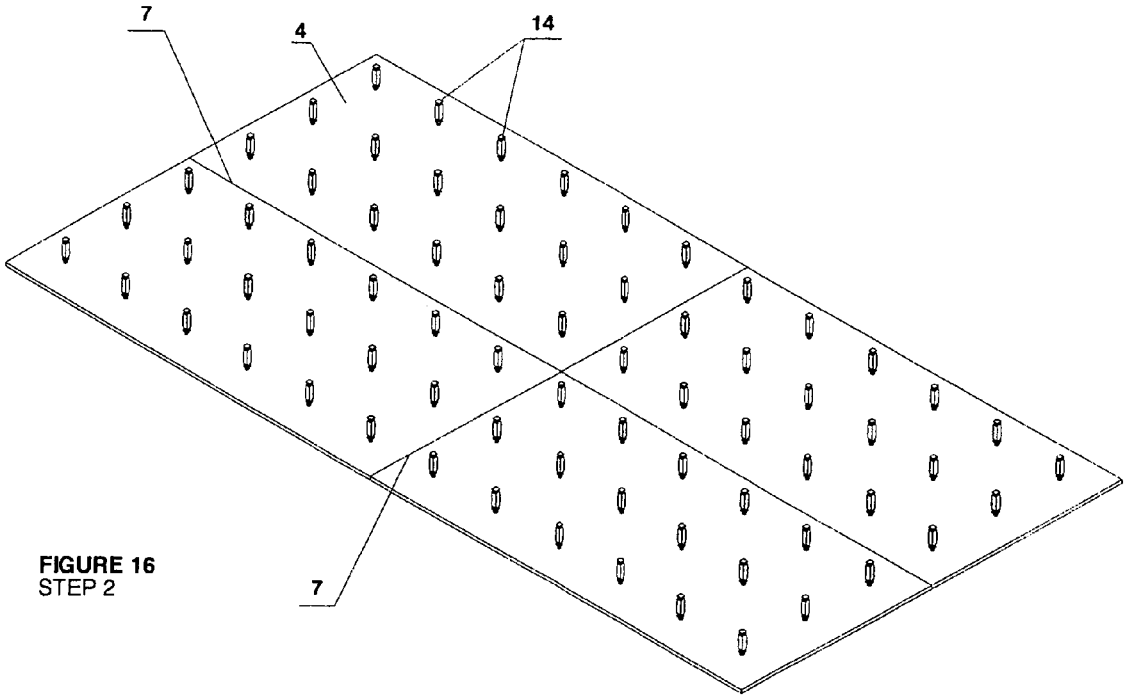
Figure 17:
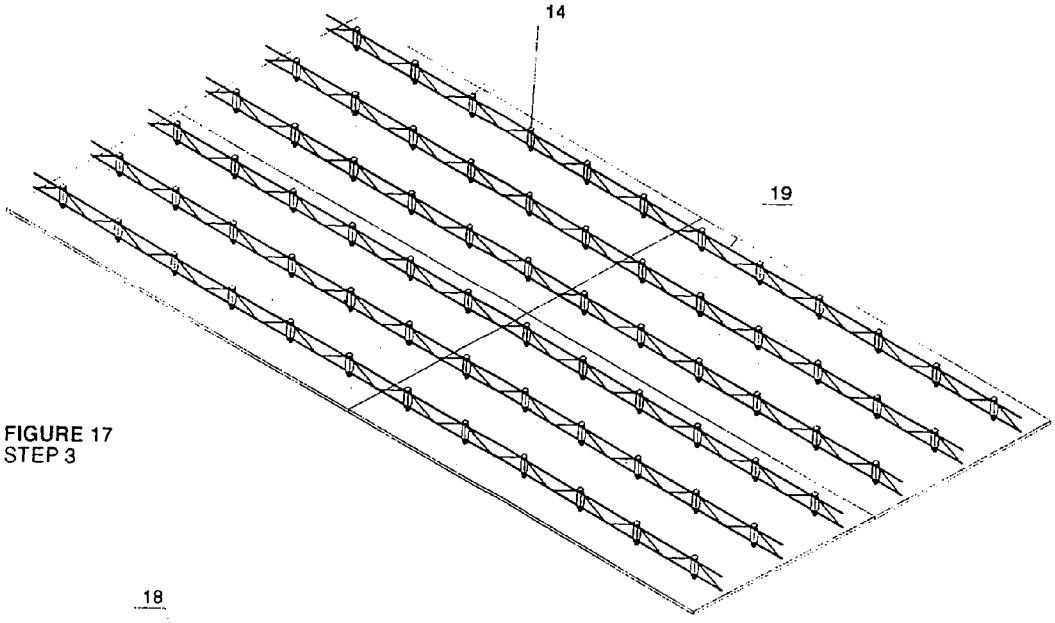
FIGS. 17–18 are isometric views corresponding to STEPS 3–4, respectively, in a building sequence of a typical slab member using two-dimensional welded reinforcement elements in combination with straight bars, standard molding boards and a set of specially designed connection devices according to an embodiment of the present invention.
Figure 18:
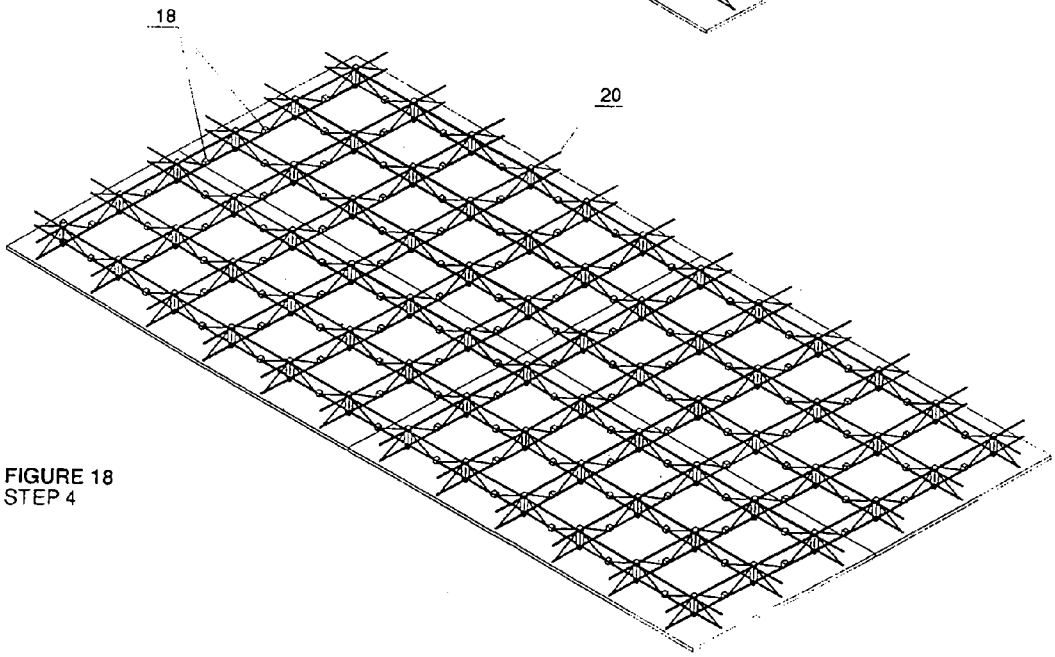
Figure 19:
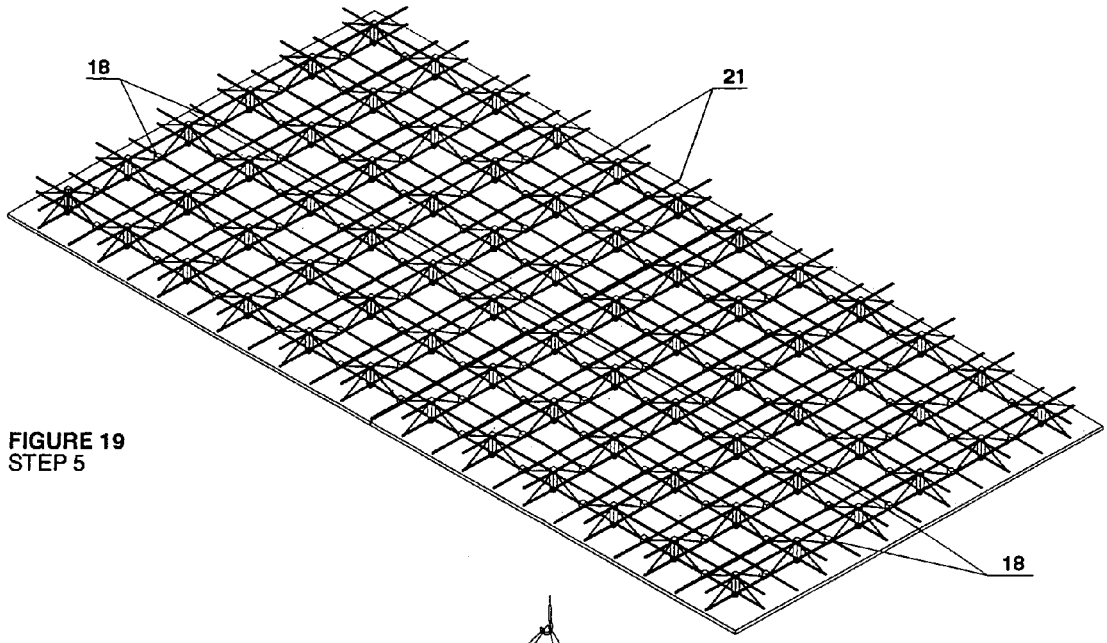
FIGS. 19–20 are isometric views corresponding to STEPS 5–6, respectively, in a building sequence of a typical slab member using two-dimensional welded reinforcement elements in combination with straight bars, standard molding boards and a set of specially designed connection devices according to an embodiment of the present invention.
Figure 20:
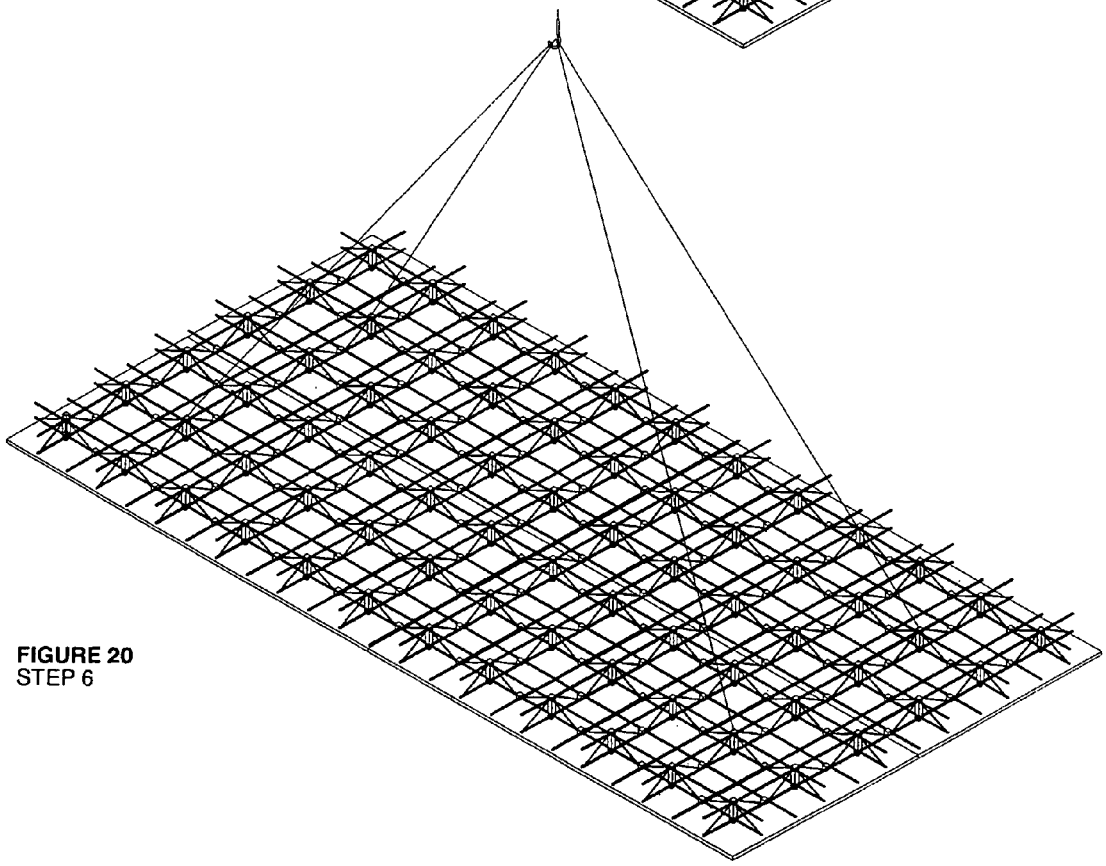
Figure 37:
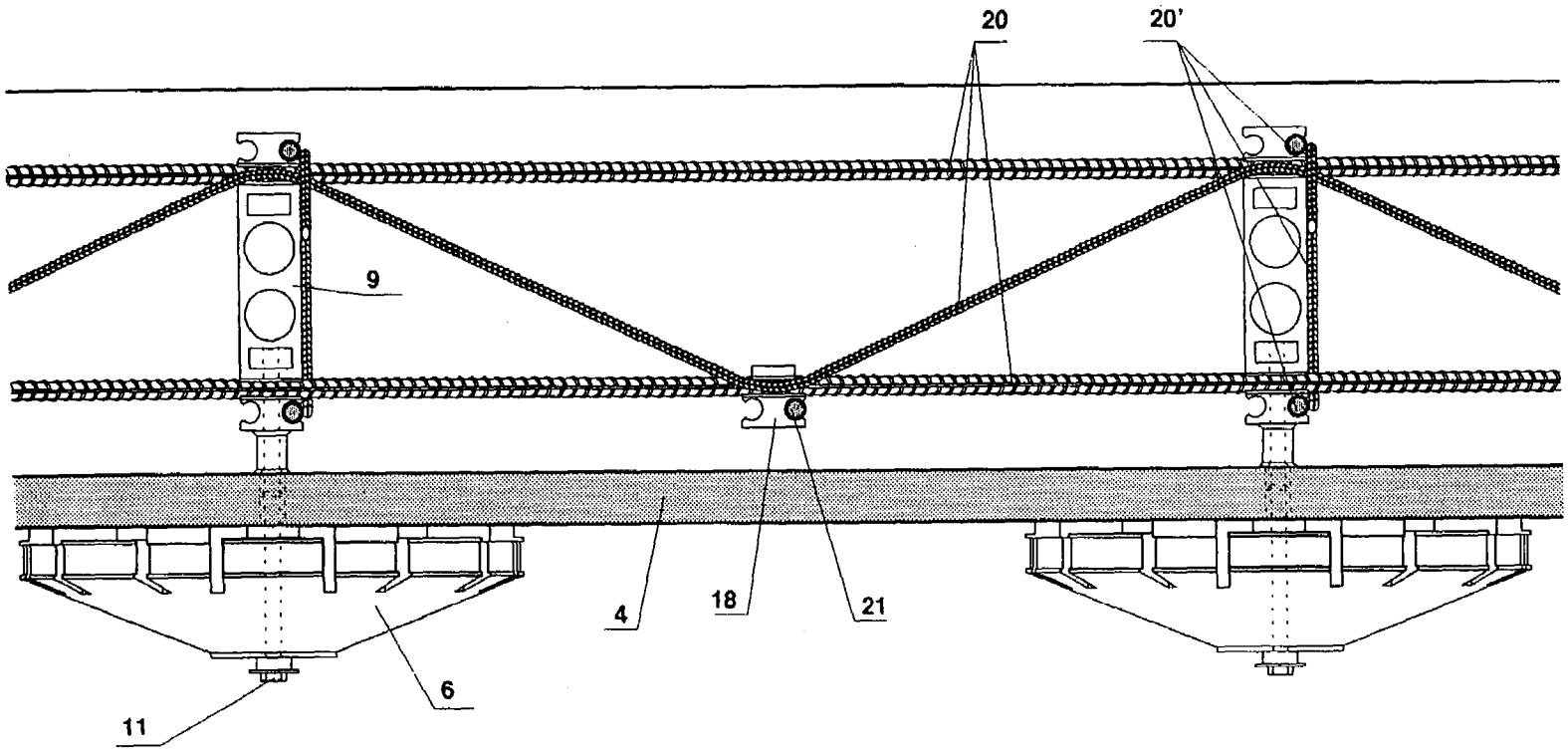
FIG. 37 is a side view corresponding to a section of a slab member with welded bar joists showing a detail of the connection unit formed by a spacer, a bolt and nut tie, and a washer. The connection unit interlocks the bars and the molding boards together according to an embodiment of the present invention.
Figure 46:
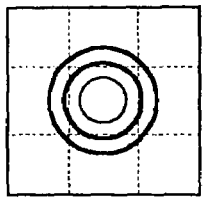
FIGS. 46–48 are plan views of an injected plastic spacer according to an embodiment of the present invention.
Figure 48:
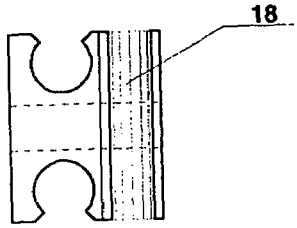
Figure 47:
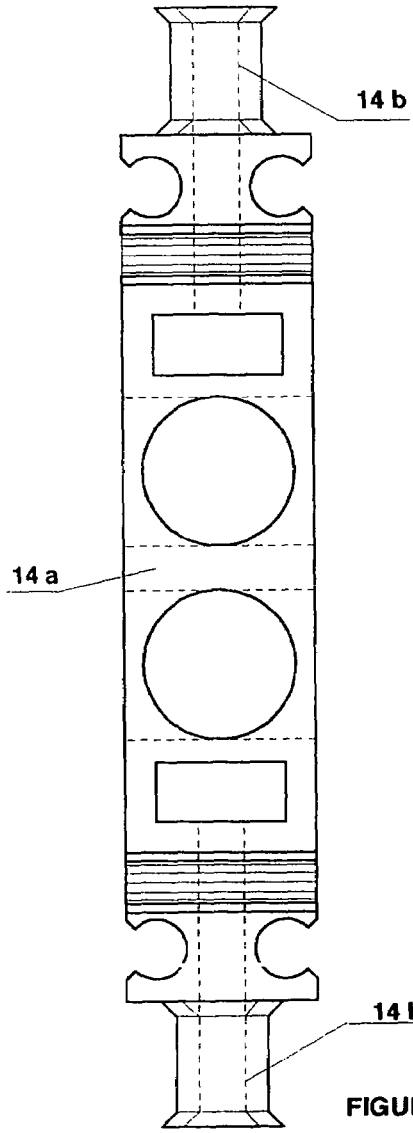
Figure 57:
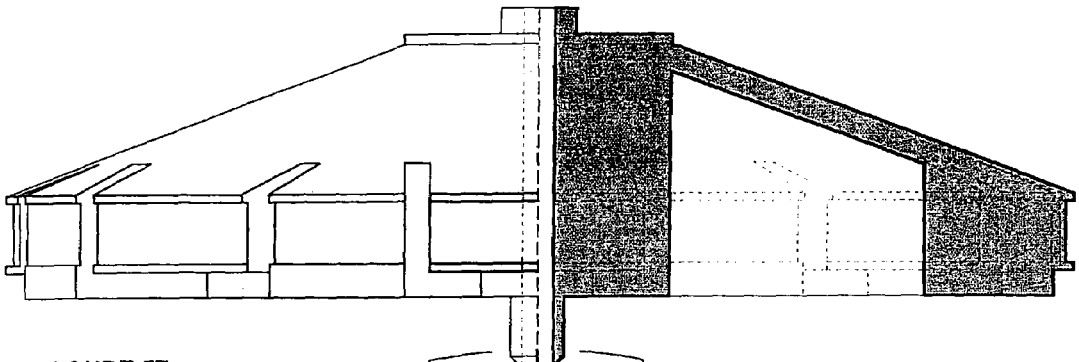
FIGS. 57–58 are plan views an half sections of an injected plastic conic washer plate according to an embodiment of the present invention.
Figure 58:
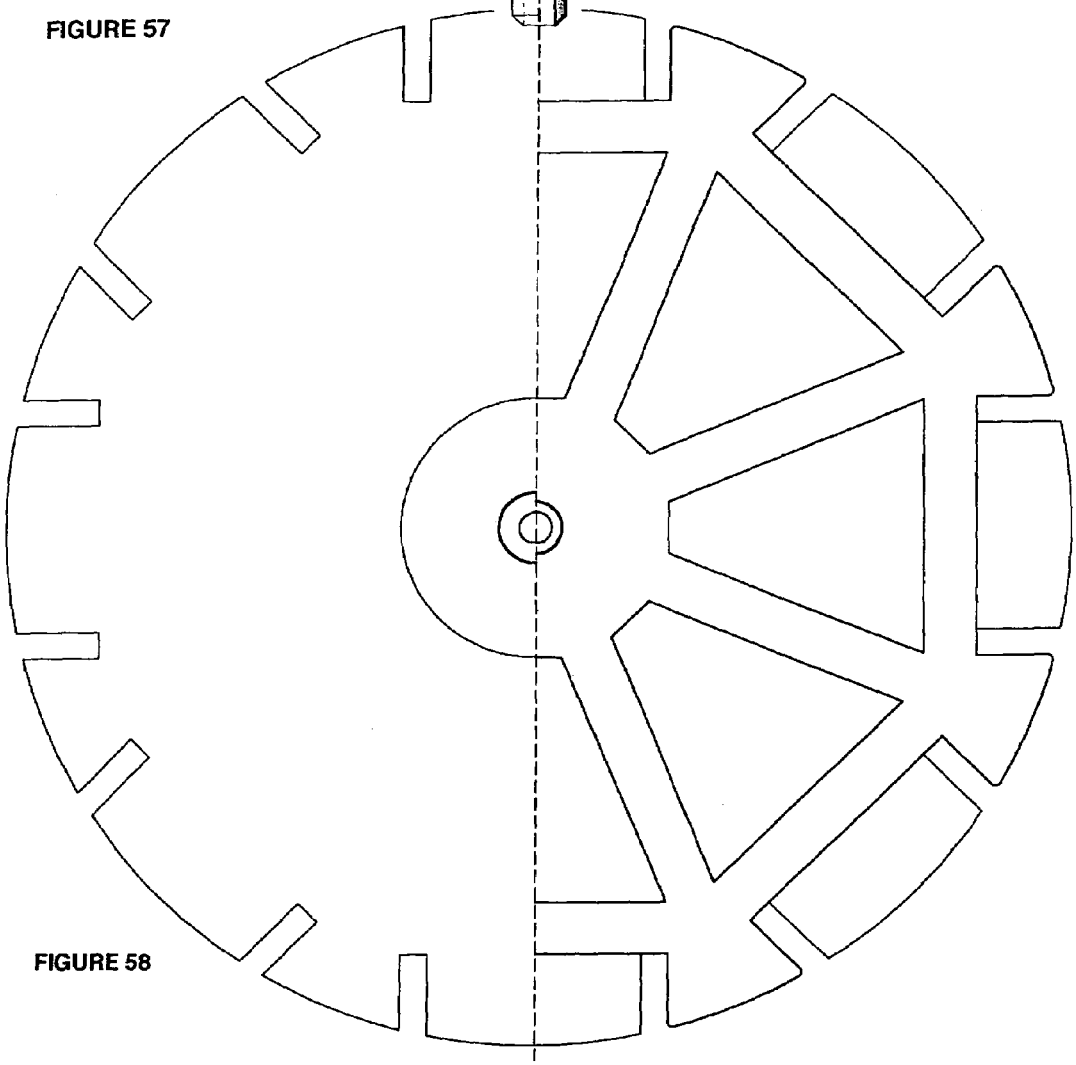

FIGS. 15–16 are isometric views corresponding to STEPS 1–2, respectively, in a building sequence of a typical slab member using two-dimensional welded reinforcement elements in combination with straight bars, standard molding boards and a set of specially designed connection devices according to an embodiment of the present invention. FIGS. 17–18 are isometric views corresponding to STEPS 3–4, respectively, in a building sequence of a typical slab member using two-dimensional welded reinforcement elements in combination with straight bars, standard molding boards and a set of specially designed connection devices according to an embodiment of the present invention. FIGS. 19–20 are isometric views corresponding to STEPS 5–6, respectively, in a building sequence of a typical slab member using two-dimensional welded reinforcement elements in combination with straight bars, standard molding boards and a set of specially designed connection devices according to an embodiment of the present invention;

FIGS. 15–20 illustrate a building sequence shown in six steps of a typical slab member, using a reinforcement framework formed by the assembly of prefabricated substantially two dimensional welded wire joists, and single bars, with standard molding boards, by means of specially designed connection devices such as spacers, bar links and washer plates. An assembly of the elements is shown in FIG. 37. The preferred spacers and links required are shown in FIGS. 46, 47 and 48. The preferred washer plates needed are shown in FIGS. 57 and 58.

FIG. 15 designates an initial stage, where preferred units of ties and spacers (14) with bolts (11) and washer plates (6) are set through perforated molding panels (4) (usually ¾" thick plywood or similar boards). The perforations should match the position and diameters of the bolts, and correspond with the distribution of the reinforcement elements. FIG. 16 corresponds to step 2, referred to the placement of the assemblage of the panels (4) with the spacer-tie units (14) on a flat base, to get a proper alignment of the slab's elements. Preferably, seal strips (7), or standard tape, should be placed in molding panel joints to prevent leakage.

FIG. 17 corresponds to step 3, referred to the setting of longitudinal reinforcement joists (19) by pressing their stringers into the matching grips of the spacers, at points where diagonal webs connect the stringers, so as to allow the passage of perpendicular joists. FIG. 18 corresponds to step 4, referred to the setting of transversal reinforcement joists (20) by pressing their stringers into the matching grips of the spacers, at points where diagonal webs connect the stringers. Specially designed plastic links (18), further detailed in FIGS. 46 and 48, are set in place pressing the stringer bars of the joists into their grips, to fix additional straight bars. FIG. 19 corresponds to step 5 referred to the setting of additional straight reinforcement bars (21), preferably by pressing them into the grips. FIG. 20 designates the final stage of the reinforcement and molding assembly for a slab member, in which it is lifted and putted on scaffolding, ready for pouring concrete in place.

Figure 23:
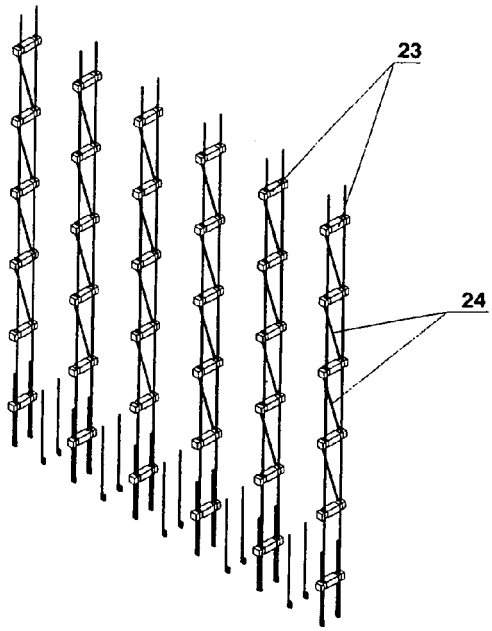
Figure 24:
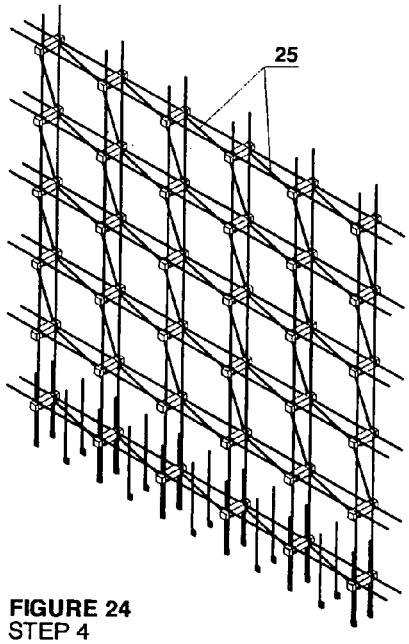
Figure 25:
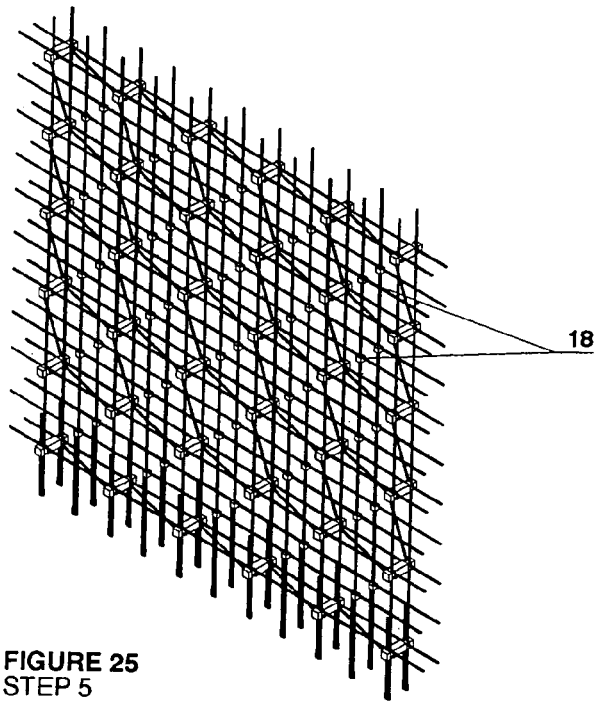
FIGS. 25–26 are isometric views corresponding to STEPS 5–6 in a building sequence of a typical wall member using straight and bent single bars, standard molding boards and a set of specially designed connection devices according to an embodiment of the present invention.
Figure 26:
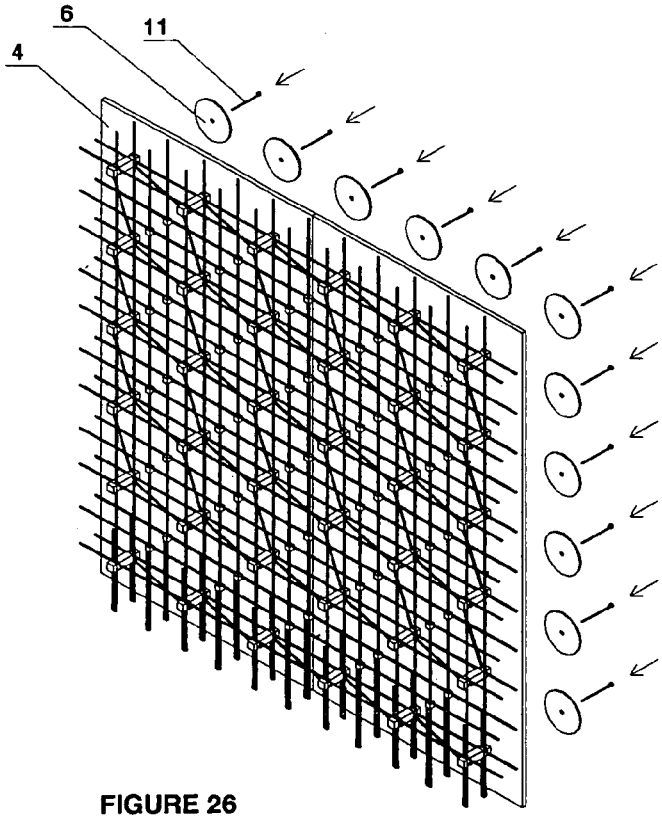
Figure 27:
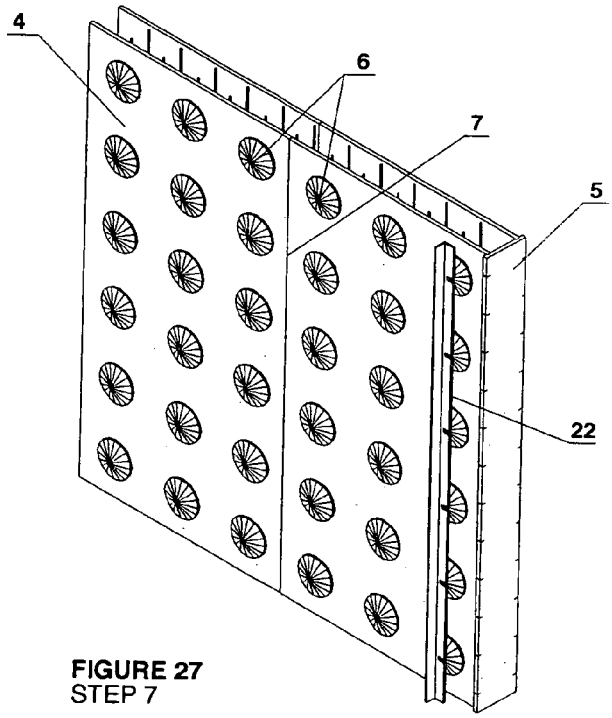
FIGS. 27–28 are isometric views corresponding to STEPS 7–8 in a building sequence of a typical wall member using straight and bent single bars, standard molding boards and a set of specially designed connection devices according to an embodiment of the present invention.
Figure 28:
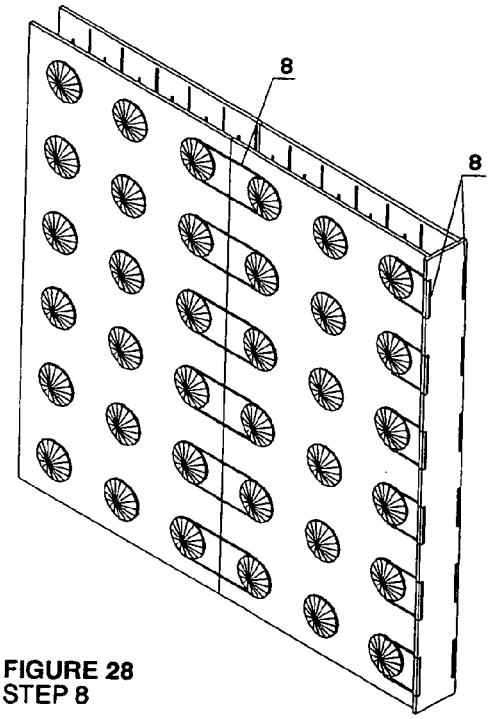

FIGS. 21–24 are isometric views corresponding to STEPS 1–4 in a building sequence of a typical wall member using straight and bent single bars, standard molding boards and a set of specially designed connection devices according to an embodiment of the present invention. FIGS. 25–26 are isometric views corresponding to STEPS 5–6 in a building sequence of a typical wall member using straight and bent single bars, standard molding boards and a set of specially designed connection devices according to an embodiment of the present invention. FIGS. 27–28 are isometric views corresponding to STEPS 7–8 in a building sequence of a typical wall member using straight and bent single bars, standard molding boards and a set of specially designed connection devices according to an embodiment of the present invention.

FIGS. 21–28 illustrate a building sequence shown in eight steps of a typical wall member using a reinforcement bar mat made of single, non-welded, straight and bent deformed bars, assembled with standard molding boards by means of specially designed connection devices. An assemblage of the elements is further shown in FIG. 42. The preferred tie-spacer and bar link unit required is further detailed in FIGS. 53, 54, 55 and 56. The preferred washer plates required are shown in FIGS. 57 and 58.

Figure 21:
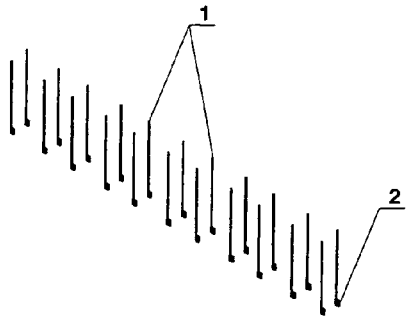
FIGS. 21–24 are isometric views corresponding to STEPS 1–4 in a building sequence of a typical wall member using straight and bent single bars, standard molding boards and a set of specially designed connection devices according to an embodiment of the present invention.
Figure 22:
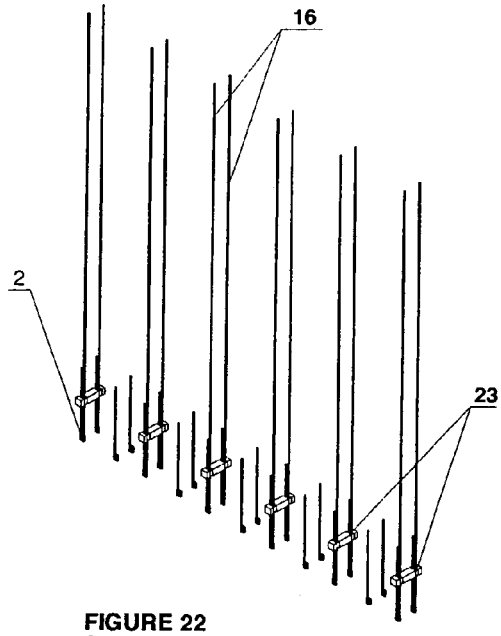

FIG. 21 designates an initial stage, with the overlapped stem bars vertical outset (1) sprouting from a floor slab, a footing or a lower wall member, aligned as to receive the reinforcement vertical bars fitted in specially designed plastic sleeves (2) (further detailed in FIGS. 50, 51 and 52). Otherwise, available mechanical splices may alternatively be used for connecting reinforcement bars. FIG. 22 corresponds to step 2, with the setting of vertical reinforcement bars (16), preferably by inserting their tips into the sleeves (2), and also connecting them by introducing each pair of the stems and bars in both sides of the specially designed tie-spacer units (23) further detailed in FIGS. 53, 54, 55 and 56. A first row of the tie-spacer units is located in this step.

FIG. 23 corresponds to step 3, with the setting of vertical diagonal webs (24) (made of reinforcement bars with slightly bent tips) by means of the tie-spacer units (23) that connect pairs of vertical bars belonging to each reinforcement curtain of the wall with the diagonal webs (24). FIG. 24 corresponds to step 4, with the setting of horizontal diagonal webs (25), as already described in the precedent step referring to the setting of vertical diagonal webs.

FIG. 25 corresponds to step 5, with the setting of additional reinforcement bars to meet structural design specific requirements, fixing them in place by means of conventional wire ties or, preferably, using the specially designed plastic links (18) further detailed in FIGS. 46 and 48. FIG. 26 corresponds to step 6, with the setting of back sheathing (4), usually formed by ¾" thick plywood or similar boards. The boards are perforated with bores of the same diameter of the tie bolts that match the spacer distribution in the reinforcement bar mat. The tie bolts (11) are introduced across the washer plates (6), the panels and the corresponding bores in the spacers already located in the bar mat.

FIG. 27 corresponds to step 7, with the setting of the frontal sheathing (4) and bulkhead mold (5), usually formed by ¾" thick plywood or similar boards. The frontal sheathing boards (4) are, as the back panels, also perforated with bores of the same diameter of the tie bolts, which correspond to the spacers distribution in the reinforcement bar mat. These frontal panels are set in place as the back panels, with tie bolts introduced across washer plates (6) and threaded into nuts inserted in the spacers already located in the bar mat. All the same, the tightening of such nuts secures the entire rigid structure formed the reinforcement and the forms. Removable braces (22) made of metallic angles in L shape with notches at the given distance between ties are successively set on each row of the ties, before tightening them, as rulers to assure proper alignment. The preferred bulkhead panel (5) is similar to that referred before when describing FIG. 3. Joint seal strips (7) are preferably placed between molding panels to prevent leakage, as already described in reference to FIG. 3.

FIG. 28 designates the final stage of a wall member with a non-welded bar mat and molding boards assembly. As in the cases illustrated before in FIG. 4 and in FIG. 14, the preferred embodiment shown considers standard tensioned straps (8) belted on the washer plates to tighten the paneling assemblage for accurately sealing joints.

Figure 29:
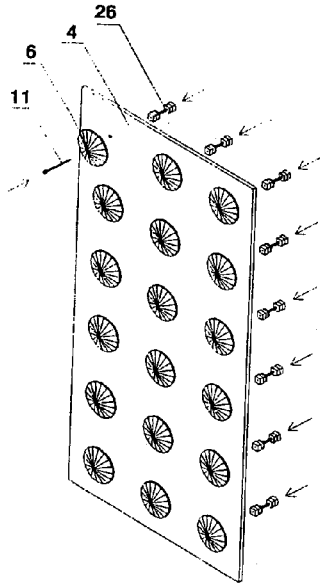
FIGS. 29–30 are isometric views corresponding to STEPS 1–2 in a building sequence of a typical slab member using straight and bent single bars, standard molding boards and a set of specially designed connection devices according to an embodiment of the present invention.
Figure 30:
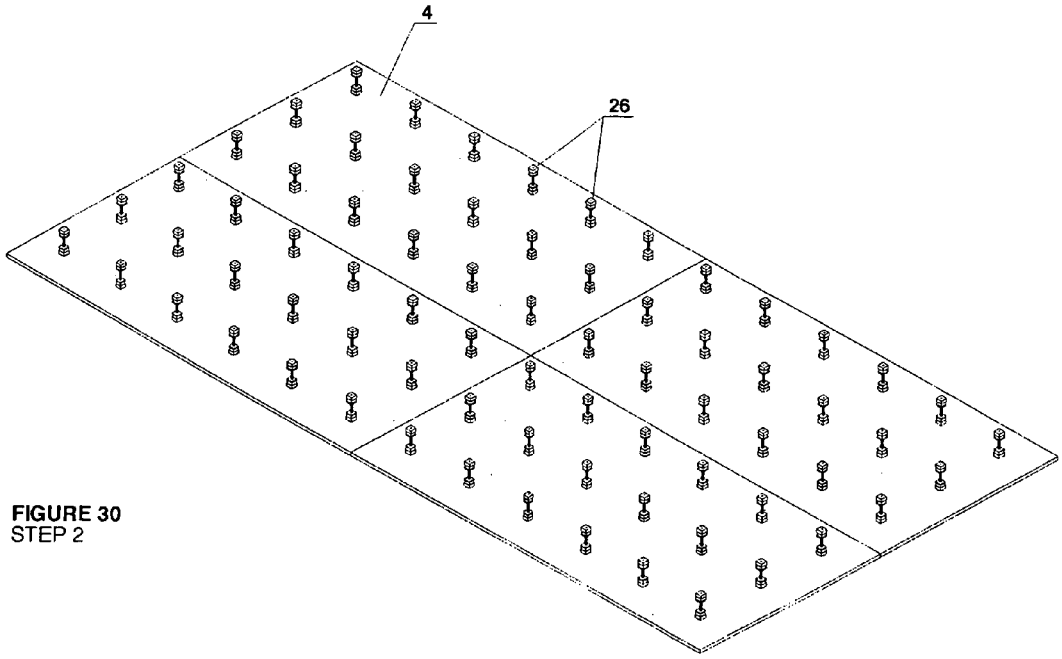
Figure 31:
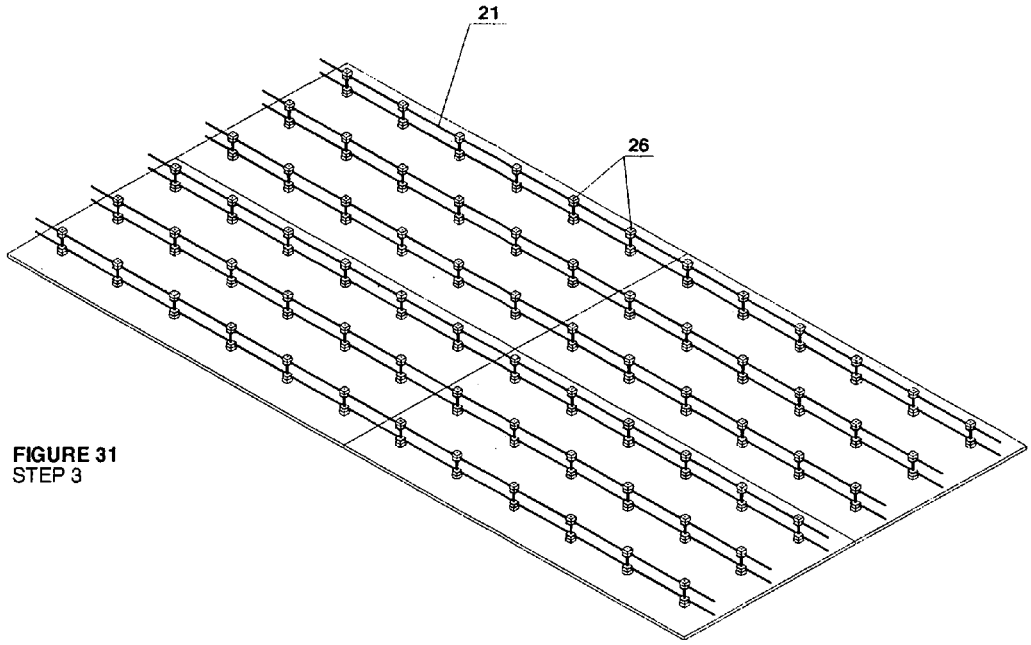
FIGS. 31–32 are isometric views corresponding to STEPS 3–4 in a building sequence of a typical slab member using straight and bent single bars, standard molding boards and a set of specially designed connection devices according to an embodiment of the present invention.
Figure 32:
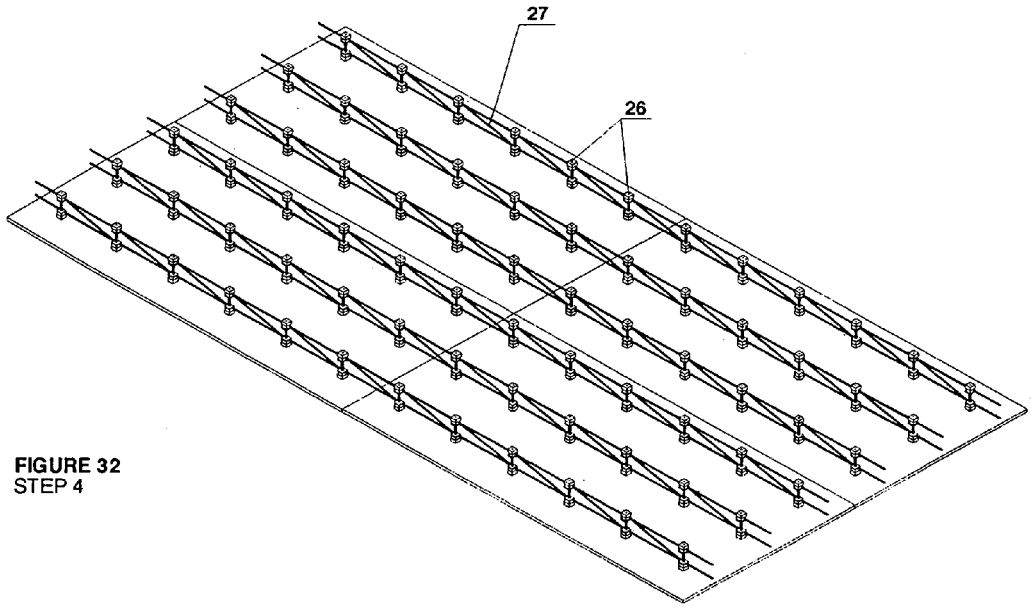
Figure 33:
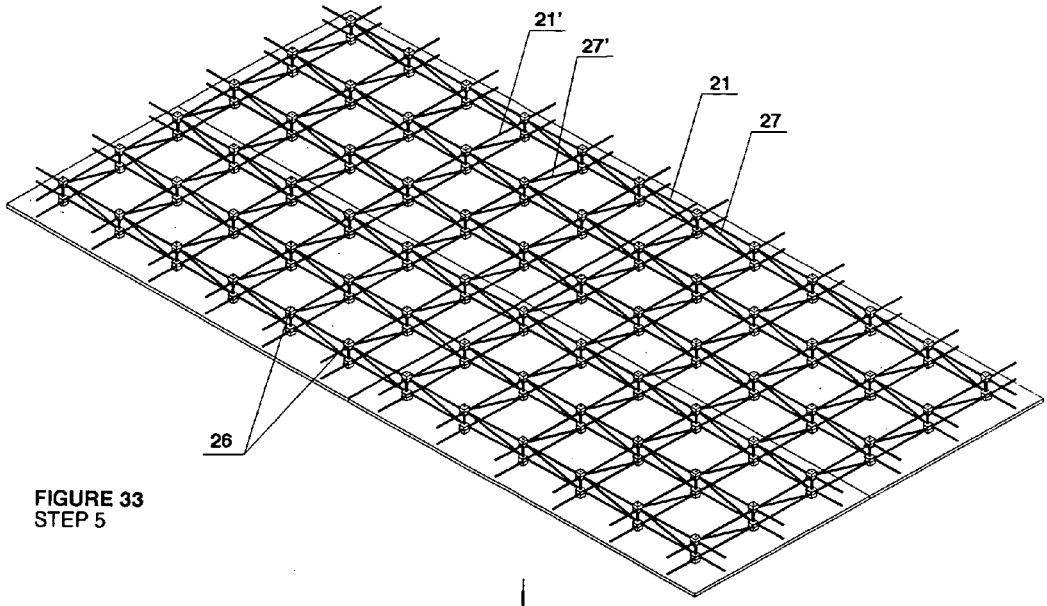
FIGS. 33–34 are isometric views corresponding to STEPS 5–6 in a building sequence of a typical slab member using straight and bent single bars, standard molding boards and a set of specially designed connection devices according to an embodiment of the present invention.
Figure 34:
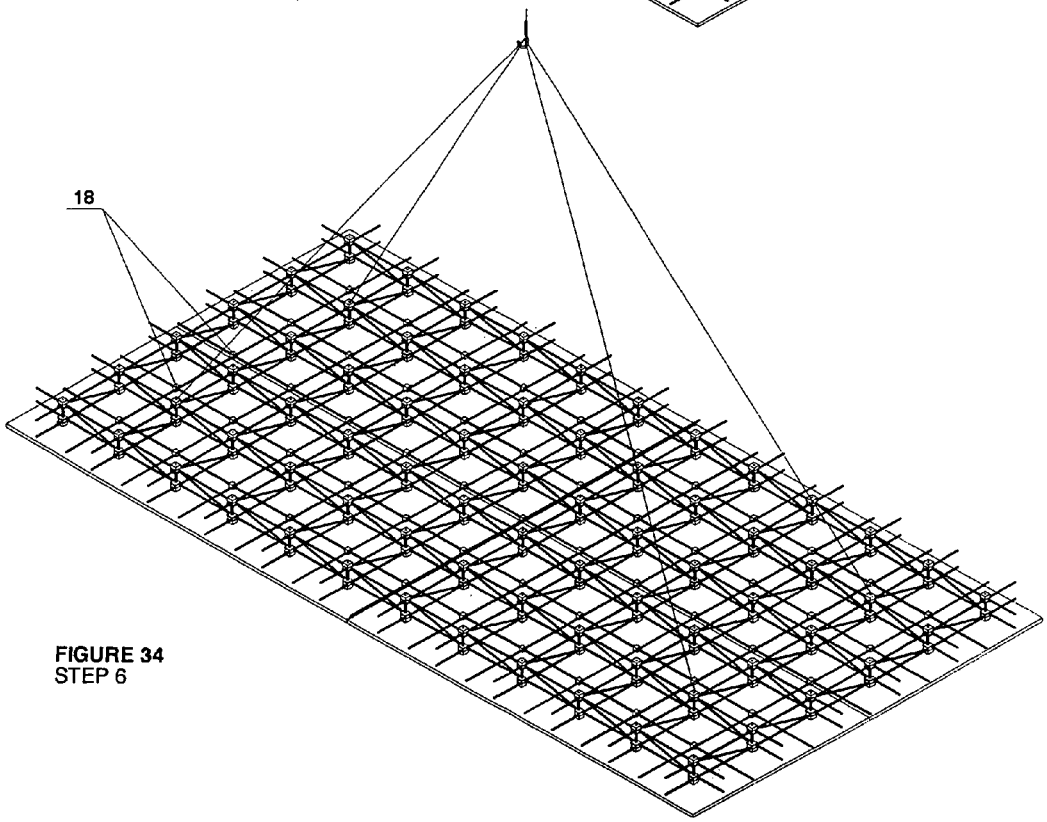
Figure 43:
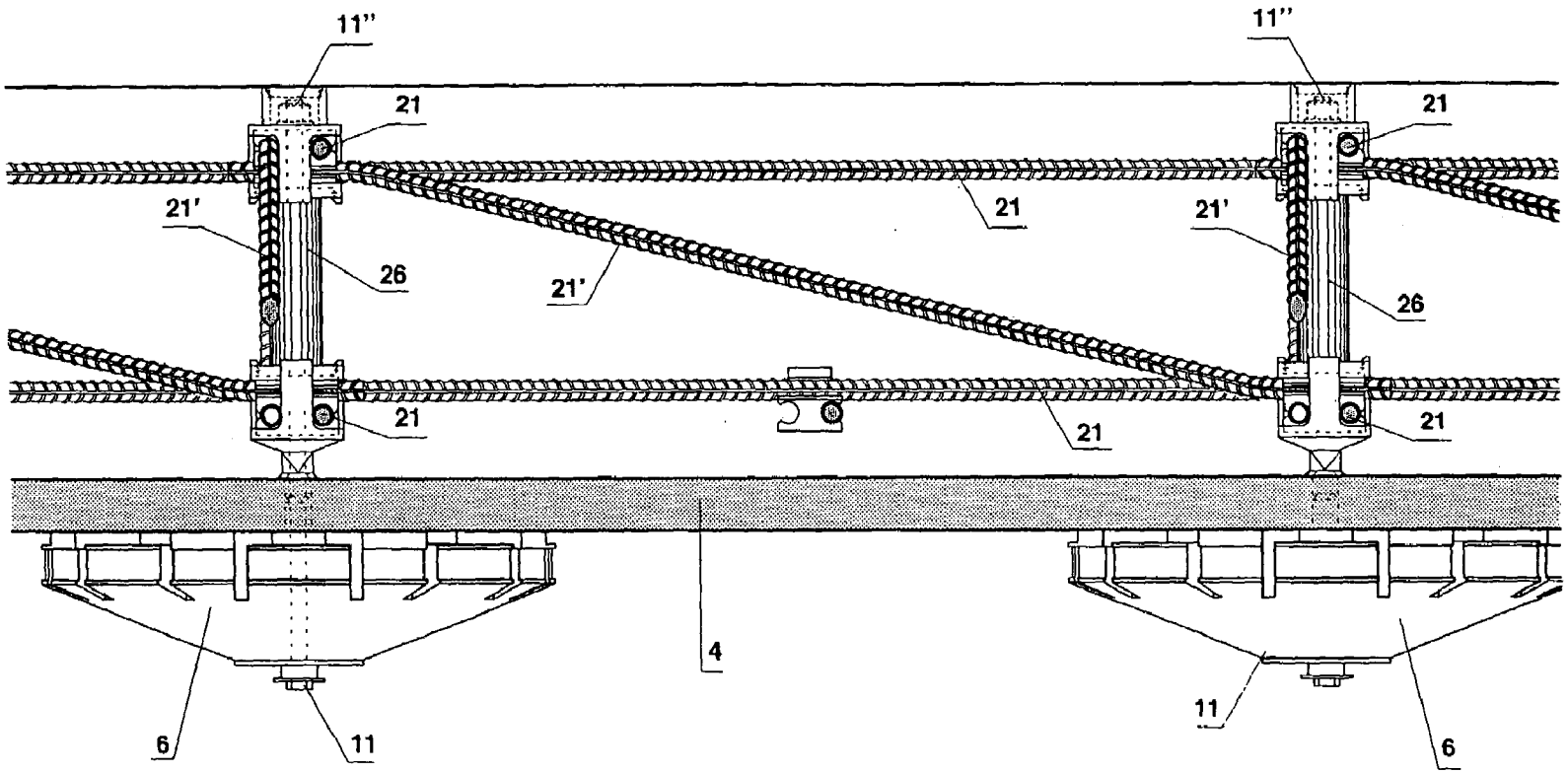
FIG. 43 is a side view corresponding to a section of a slab member with non-welded straight and bent reinforcement bars, showing a detail of the connection unit formed by a spacer, a bolt and nut tie, and a washer. The connection unit interlocks the bars and the molding boards together.
Figure 53:
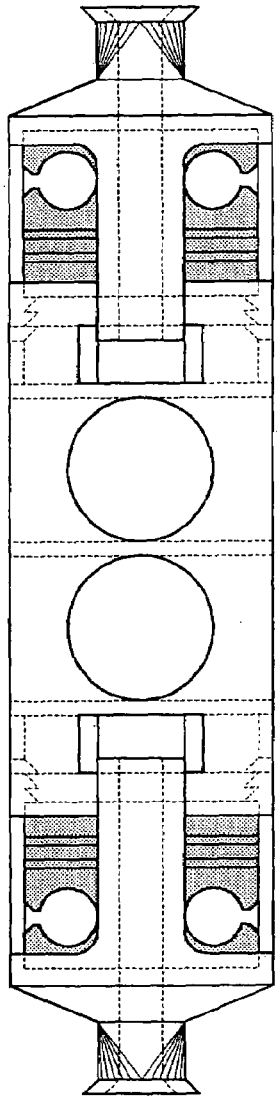
FIGS. 53, 53' and 54 are plan views of an injected plastic spacer and bar connector according to an embodiment of the present invention. The element is to be used in building sequences shown in FIGS. 21–34 to interlock non-welded reinforcement bars and the molding boards together.
Figure 53:
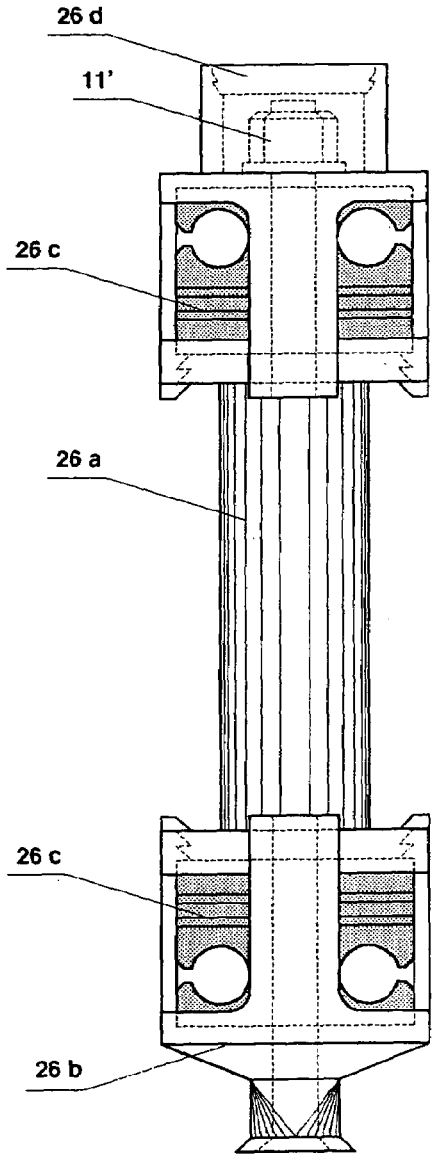

FIGS. 29–30 are isometric views corresponding to STEPS 1–2 in a building sequence of a typical slab member using straight and bent single bars, standard molding boards and a set of specially designed connection devices according to an embodiment of the present invention. FIGS. 31–32 are isometric views corresponding to STEPS 3–4 in a building sequence of a typical slab member using straight and bent single bars, standard molding boards and a set of specially designed connection devices according to an embodiment of the present invention. FIGS. 33–34 are isometric views corresponding to STEPS 5–6 in a building sequence of a typical slab member using straight and bent single bars, standard molding boards and a set of specially designed connection devices according to an embodiment of the present invention;

FIGS. 29–34 illustrate a building sequence shown in six steps of a typical slab member using a reinforcement bar mat made of single, non-welded, straight and bent deformed bars, assembled with standard molding boards by means of specially designed connection devices. An assembly of the elements is shown in FIG. 43. The preferred spacers and links required are shown in FIGS. 53' and 54. The preferred washer plates required are shown in FIGS. 57 and 58.

FIG. 29 designates an initial stage, where preferred units of tie-spacers (26) with bolts (11) and washers (6) are set through perforated molding panels (4), usually ¾" thick plywood or similar boards. The perforations should match the bolt's diameter and correspond with the distribution of the reinforcement elements. FIG. 30 corresponds to step 2, referred to the placement of the assemblage of the panels (4), tie-spacer units (26) and washer plates (6) on a flat base, to assure the alignment of the slab parts.

FIG. 31 corresponds to step 3, referred to the setting of the longitudinal reinforcement bars (21) by pressing them into the slots of the soft plastic grips of the spacers (26). FIG. 32 corresponds to step 4, referred to the setting of longitudinal diagonal webs (27) made of deformed bars with bent tips, by also introducing them into the grips belonging to the spacer units (26)

FIG. 33 corresponds to step 5, referred to the setting of transversal reinforcement bars (21') and transversal diagonal webs (27'), as described before in the cases of longitudinal bars (21) and longitudinal webs (27). A rigid double curtain reinforcement and molding assembly is obtained by tightening the nuts of the tie bolts in the tie-spacer units (26), to press the bars placed in the soft plastic inserts within them as to assure enough grip for attaining the desired stiffness of the entire structure. FIG. 34 designates the final stage of the reinforcement and molding assembly for a slab member, in which the additional reinforcement bars needed to meet structural design are fixed in place by means of conventional wire ties or, preferably, using the specially designed plastic links (18) further detailed in FIGS. 46 and 48. Then the assemblage is lifted and putted on scaffolding, ready for pouring concrete in place.

Figure 35:
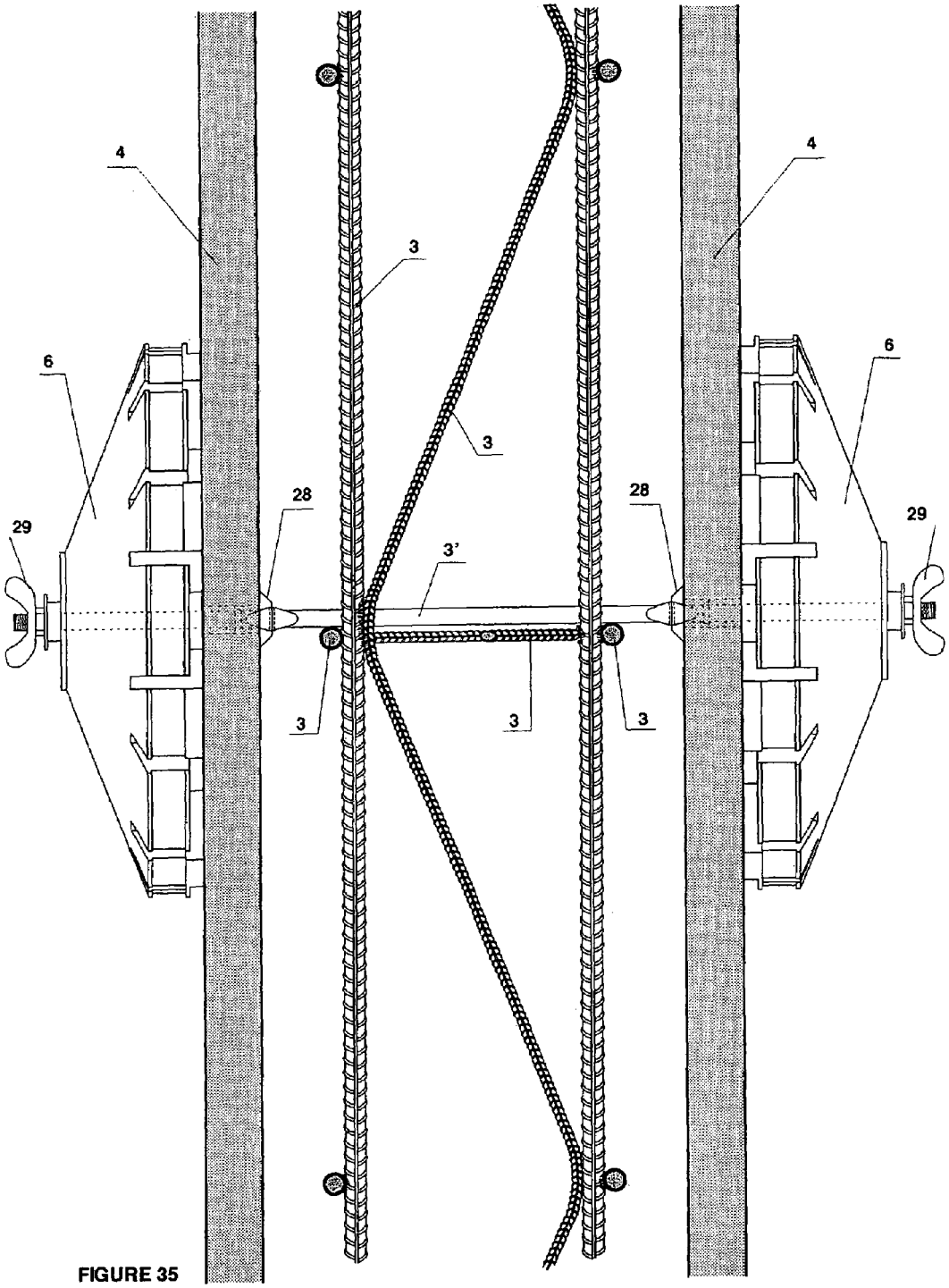
FIG. 35 is a side view corresponding to a vertical section of a wall member with a three dimensional welded reinforcement web showing a detail of the ties and washer plates that fasten the molding panels according to an embodiment of the present invention.

FIG. 35 is a side view corresponding to a vertical section of a wall member with a three dimensional welded reinforcement web showing a detail of the ties and washer plates that fasten the molding panels according to an embodiment of the present invention. FIG. 35 is a vertical section of a wall member with a three-dimensional welded reinforcement web, namely a cage, detailing a preferred assemblage formed by the cage (3), with welded tie rods (3') included, the sheathing in both faces (4), a pair of small washer stoppers (28), and a pair of washer plates (6) for stress distribution on the molding boards, secured by a couple of wing nuts (29) on the tie rods (3') threaded endings. This detail renders a partial view of a cage formed by a double curtain reinforcement connected by welded diagonal webs in both vertical and horizontal planes and by the welded tie rods (3'). The segments of the bars converge approximately at their welded joints to form triangular arrangements so as to stiffen the entire three-dimensional reinforcement bar mat. The rigid bar mat is to be prefabricated, either in series of standard bar sizes and formats, or custom built, comprising all the reinforcement needed or at least the minimum required to form a rigid cage, allowing additional single bars to be placed in site, in accordance to specific structural design. The tie rods (3') included in the rigid bar mat are located separated from each other at certain distances depending on the molding panels resistance to the local pressure of the placed concrete. Such ability is enhanced in the case of the standard ¾" thick plywood boards shown by the large conic washer plates (6) considered in this preferred embodiment. The washer plates, further detailed in FIGS. 57 and 58, are locked in this preferred embodiment by wing nuts (29) that can be easily installed and removed in the threaded tips of the tie rods, although other devices, such as clamps, may be used for the same purpose. The tie rods (3') have a couple of notches to retain the molding panels in their proper position with the preferred aid of a pair of small plastic stopper washers (28) that fit in place. The notches also allow the tie rods to be easily broken by bending them, to withdraw their remaining tips afterwards the forms are removed.

Figure 36:
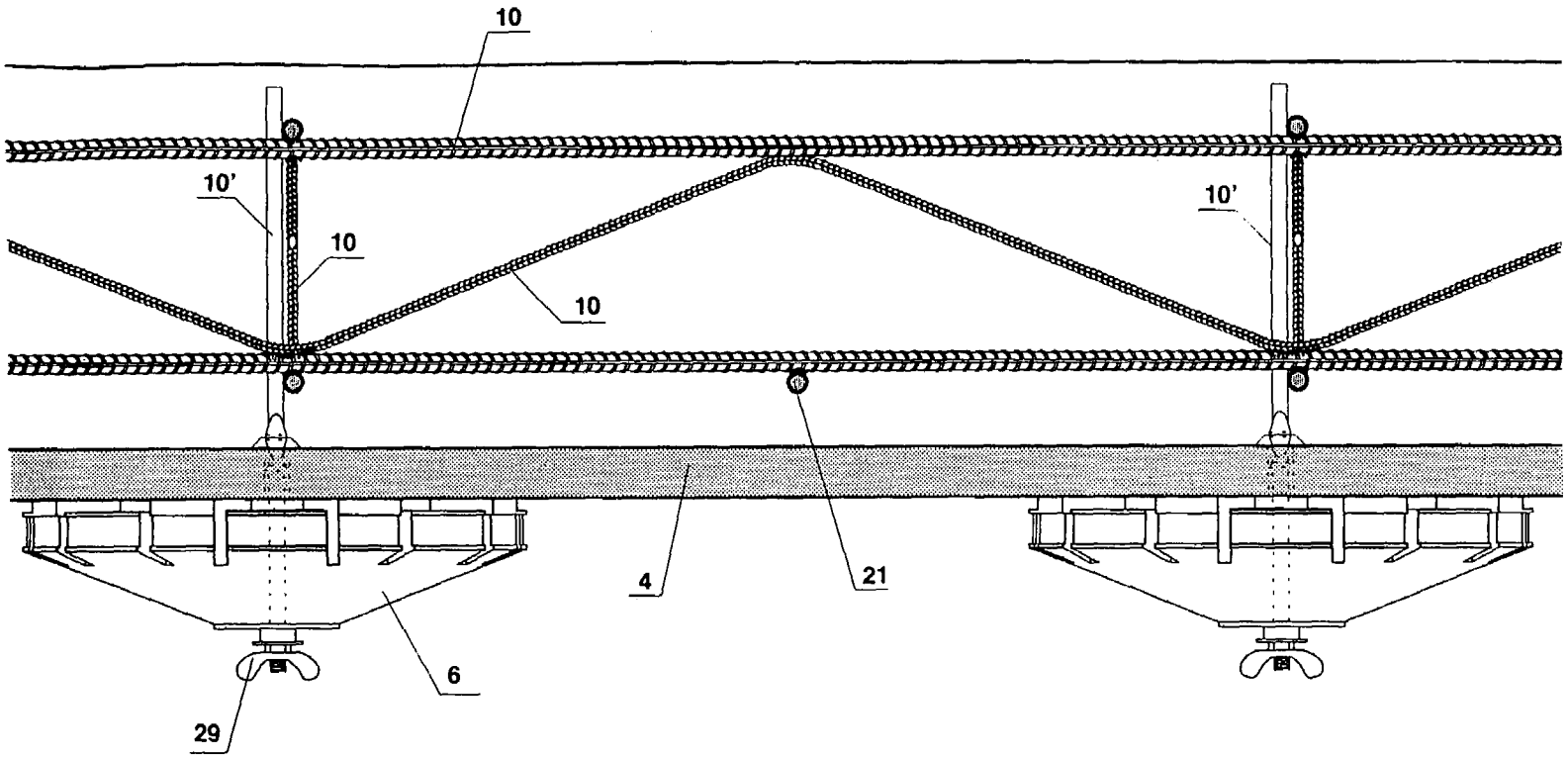
FIG. 36 is a side view corresponding to a horizontal section of a slab member with a three dimensional reinforcement framework, showing a detail of the ties and washer plates that fasten the molding boards according to an embodiment of the present invention.

FIG. 36 is a side view corresponding to a section of a slab member with a three dimensional reinforcement framework, showing a detail of the ties and washer plates that fasten the molding boards according to an embodiment of the present invention. FIG. 37 is a side view corresponding to a section of a slab member with welded bar joists showing a detail of the connection unit formed by a spacer, a bolt and nut tie, and a washer. The connection unit interlocks the bars and the molding boards together according to an embodiment of the present invention;

FIG. 36 and FIG. 37 are vertical sections of slab members, either formed by welded joists (substantially two-dimensional elements) and straight bars (substantially linear elements), or completely prefabricated with a welded three-dimensional rigid reinforcement web. FIG. 36 shows a detail of a preferred assemblage formed by the three-dimensional reinforcement cage (10), the sheathing (4), a welded tie-rod (10') and a conic washer plate for stress distribution (6), preferably secured by a wing nut (29). This detail renders a partial view of a larger framework formed by a double curtain reinforcement (10) connected by welded diagonal webs in both longitudinal and transversal planes. The substantially linear segments of the bars converge approximately at their welded joints to form triangular arrangements not parallel to the slab plane, so as to stiffen the section of the entire three-dimensional bar mat. The rigid bar mat is to be prefabricated as in the case previously referred to FIG. 35.

FIG. 37 shows a detail of a preferred assemblage formed by the two-dimensional reinforcement elements, namely longitudinal joists (20) and transversal joists (20'), and single bars (21), with the sheathing (4), using tie-spacer units (9). The tie-spacer unit (9), further detailed in FIGS. 46, 47, 48 and 49, is formed by a plastic spacer with slots to grip each of the crossed bars pressed into them, matching both reinforcement curtains, and by removable tie bolts (11). The tie-spacer units are to be located in practical coincidence with the intersection of the bars in both curtains and the diagonal webs welded joints, so as to collaborate in stiffening the whole assembly (without causing bending moments on the bars). Thus, the preferred distance of 40 cms. (aprox. 16") between the tie-spacer units must be coordinated with the bar distribution in the reinforcement framework, and also may as well correspond to a module of the molding boards standard format, in accordance with the resistance to the pressure of the poured concrete the boards have in combination with the washer plate (6) that hold them fastened by the tie bolts (11).

FIG. 38 is a side view corresponding to a vertical section of a wall member showing reinforcement with welded bar joists, standard molding boards and connection devices according to an embodiment of the present invention. FIG. 39 is a side view corresponding to a horizontal section of a wall member showing reinforcement with welded bar joists, standard molding boards and connection devices according to an embodiment of the present invention.

FIGS. 38 and 39 correspond to vertical and horizontal sections of a typical wall member setting, with a reinforcement framework formed by the assembly of prefabricated welded wire joists (13)(15), single bars (16)(17) and standard molding boards (4) by means of specially designed connection units (14). The joists (13)(15) are further detailed in FIGS. 44 and 45. The connection units (14) are further detailed in FIGS. 46, 47, 48 and 49. The washer plates (6) are further detailed in FIGS. 57 and 58. Alternatives of the joint seal strips (7) are further detailed in FIGS. 59, 60, 61 and 62.

Figure 40:
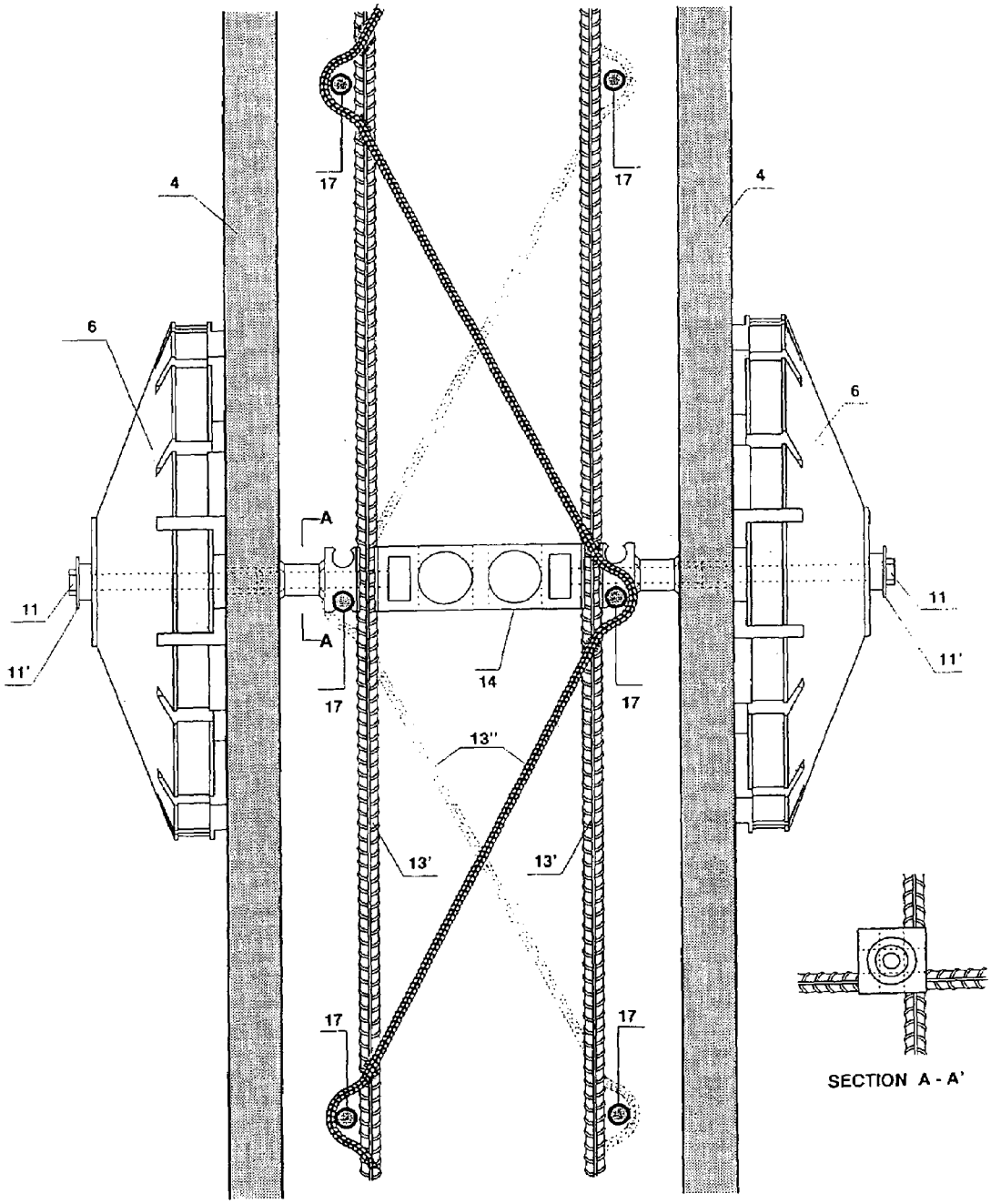
FIG. 40 is a side view corresponding to a vertical section of a wall member with welded bars joists showing a detail of the connection unit formed by a spacer, bolt and nut ties, and a pair of washer plates to fasten the standard molding boards according to an embodiment of the present invention.

FIG. 40 is a side view corresponding to a vertical section of a wall member with welded bars joists showing a detail of the connection unit formed by a spacer, bolt and nut ties, and a pair of washer plates to fasten the standard molding boards according to an embodiment of the present invention.

FIG. 40 is an enlarged detail of the section of the wall member in FIG. 39, that shows the assemblage of molding boards (4), spacers (14), washer plates (6), bolts (11), washers (11') and the reinforcement rigid framework formed by vertical wire joists with a pair of stringers (13') connected by welded trusses (13") of bent wire that lets openings into which perpendicular horizontal straight bars (17) are fitted in as to complete a double curtain bar mat. The section A–A' shows the square profile of the spacer (14) with the slots that grip bars at their crossing points.

Figure 41:
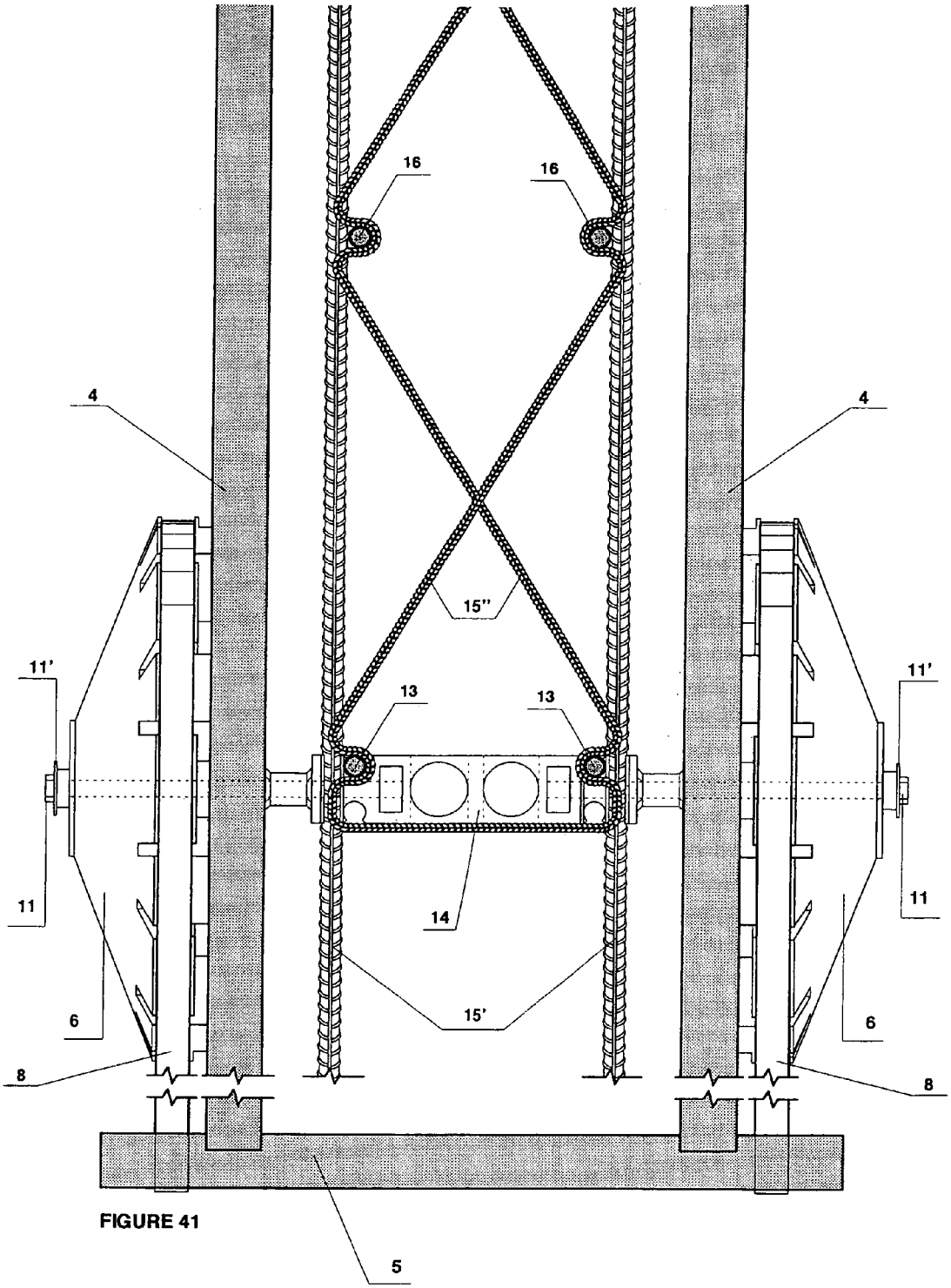
FIG. 41 is a side view corresponding to a horizontal section of a wall member with welded bars joists, showing a detail of the same connection unit in FIG. 40, and a typical bulkhead ending according to an embodiment of the present invention.

FIG. 41 is a side view corresponding to a horizontal section of a wall member with welded bars joists, showing a detail of the same connection unit in FIG. 40, and a typical bulkhead ending according to an embodiment of the present invention;

FIG. 41 is an enlarged detail of a typical border of the wall's horizontal section in FIG. 38, that shows the assemblage of side sheathing (4), a bulkhead mold (5), spacers (14), washer plates (6), bolts (11), washers (11') and the reinforcement rigid framework formed by vertical bars and straight bars (16), whose tips are fitted into openings let by a superior horizontal joist (15) with a pair of stringers (15') connected by welded trusses (15"). The bulkhead mold has a pair of longitudinal grooves into which the edges of both side panels are inserted, and is preferably fastened by tensed straps belted in a groove around the washers (6) and in slots made by saw cuts in the edges of this board.

Figure 42:
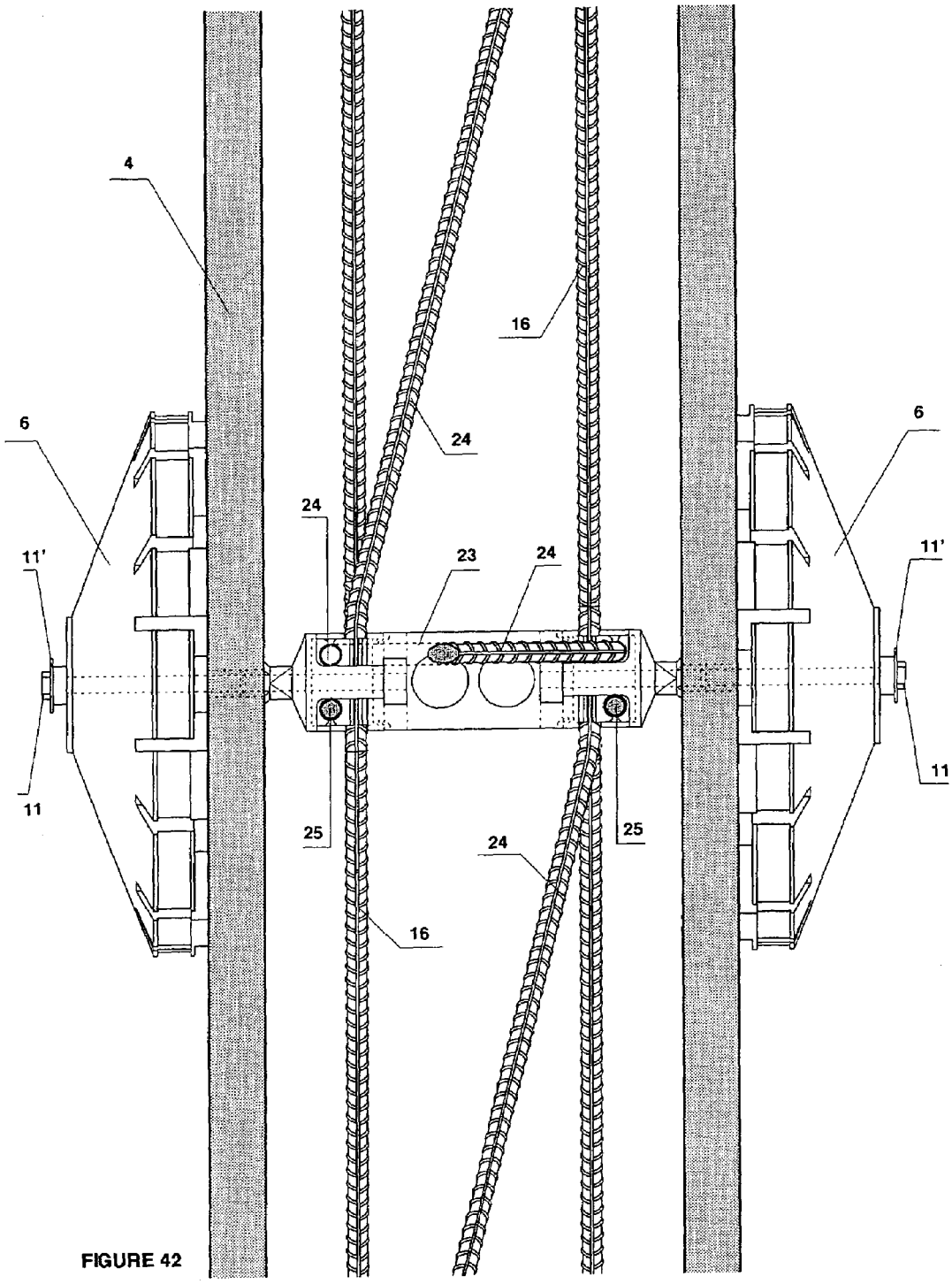
FIG. 42 is a side view corresponding to a section of a wall member with non-welded straight and bent reinforced bars, showing a detail of the connection unit formed by a spacer, a bolt and nut tie, and a pair of washer plates. The connection unit interlocks the bars and the molding boards together according to an embodiment of the present invention.

FIG. 42 is a side view corresponding to a section of a wall member with non-welded straight and bent reinforced bars, showing a detail of the connection unit formed by a spacer, a bolt and nut tie, and a pair of washer plates. The connection unit interlocks the bars and the molding boards together according to an embodiment of the present invention.

FIG. 42 is a detailed section of a typical wall member which shows the assemblage of side sheathing (4), spacers (23), washer plates (6), bolts (11), washers (11') and a reinforcement rigid framework with straight vertical (16) and horizontal (25) bars, and diagonal webs (24). The bars are griped by the soft plastic parts of the spacers (23) as the tie-bolts (11) are tightened. The spacers (23) are further detailed in FIGS. 53, 54, 55 and 56.

FIG. 43 is a side view corresponding to a section of a slab member with non-welded straight and bent reinforcement bars, showing a detail of the connection unit formed by a spacer, a bolt and nut tie, and a washer. The connection unit interlocks the bars and the molding boards together.

FIG. 43 is a vertical section of a slab member with a rigid reinforcement web integrated by non-welded straight and bent bars, detailing a preferred arrangement formed by the reinforcement, the sheathing (4), tie-spacer units (26) with washer plates (6) secured by a bolt (11) and nut (11") couple. This detail renders a partial view of a larger framework formed by a double curtain reinforcement (21) and diagonal webs (21') in both longitudinal and transversal planes connected between them and with the sheathing (4) by the tie-spacer units (26) in order to attain a rigid structure. The tie-spacer units (26), further detailed in FIGS. 53' and 54, are designed to grip the reinforcement bars as the tie-bolts introduced across them are tightened, preferentially by a nut (11") in their upper end. The tie-bolts (11) also support the molding boards through the stress distribution washer plates (6), further detailed in FIGS. 57 and 58, interlocking the whole assemblage of reinforcement and sheathing.

Figure 44:
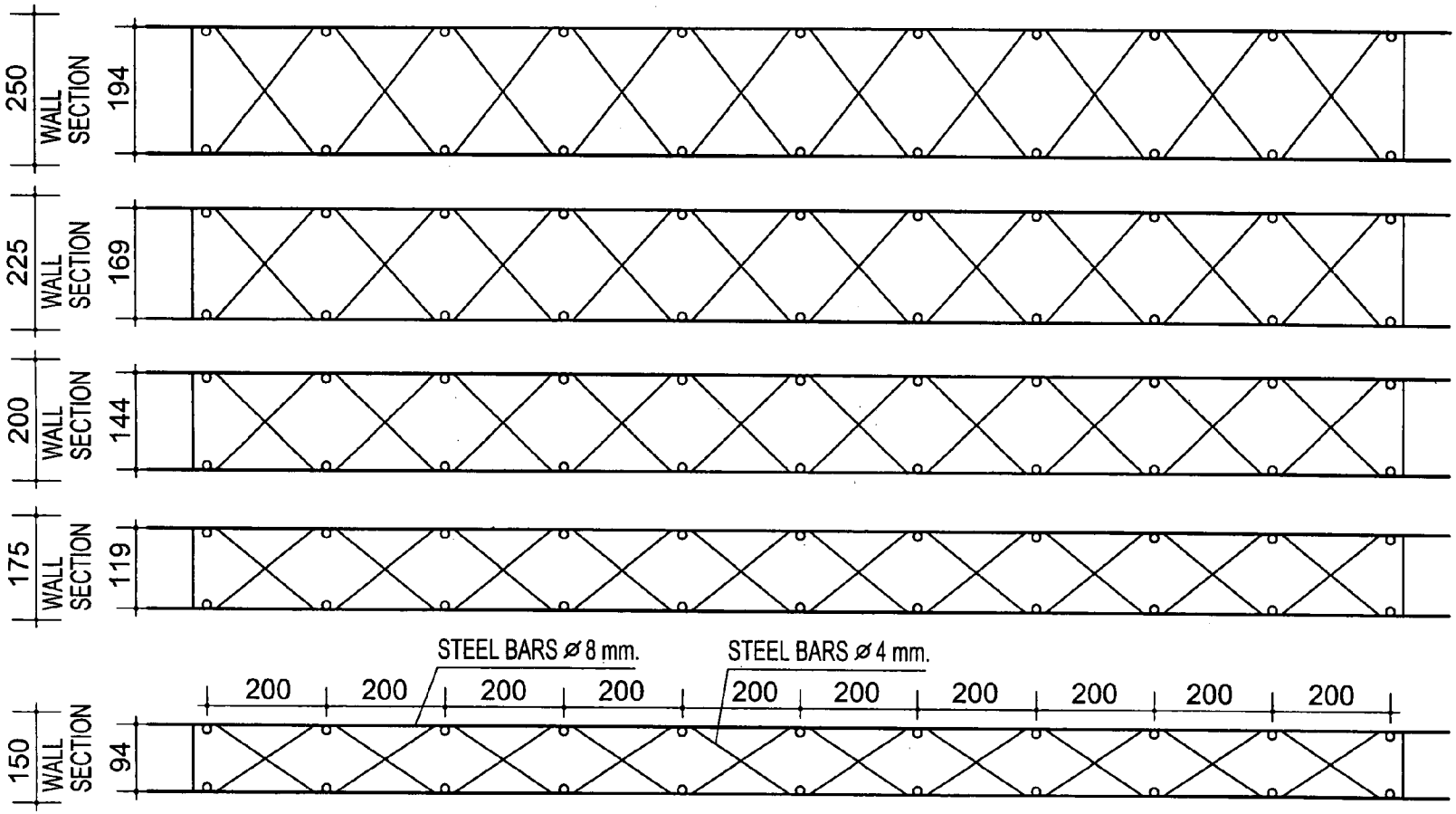
FIG. 44 is a side view corresponding to a series of horizontal prefabricated joists, namely two dimensional welded elements, intended to be used in the building sequence formerly described in FIGS. 7–20.

FIG. 44 is a side view corresponding to a series of vertical and horizontal prefabricated joists, namely two dimensional welded elements, intended to be used in the building sequence formerly described in FIGS. 7–20. FIG. 44 shows a preferred series of prefabricated horizontal joists of standard sizes for typical wall sections, intended for the use considered in the building sequence described in FIGS. 7 to 14, and also detailed in FIGS. 38, 39 and in FIG. 41. The joists stiffen the assemblage of the reinforcement and molding of a wall in its horizontal direction, fixing in place the upper endings of the vertical joists and bars already placed, to form a typical double curtain reinforcement. The stringers of the joists correspond to pairs of horizontal bars connected by the welded wire webs that form the triangular arrangements needed to structure a rigid lattice. The webs result of a couple of continuous wires bent as shown, in the form of two overlapped zigzag figures. This pattern has a series of openings let between the welded joints of the bent wire webs and the stringers of these horizontal joists, into which the upper tips of the vertical joists are inserted, assuring their proper alignment, and stiffening the wall's reinforcement and molding assembly at its upper horizontal border.

Figure 45:
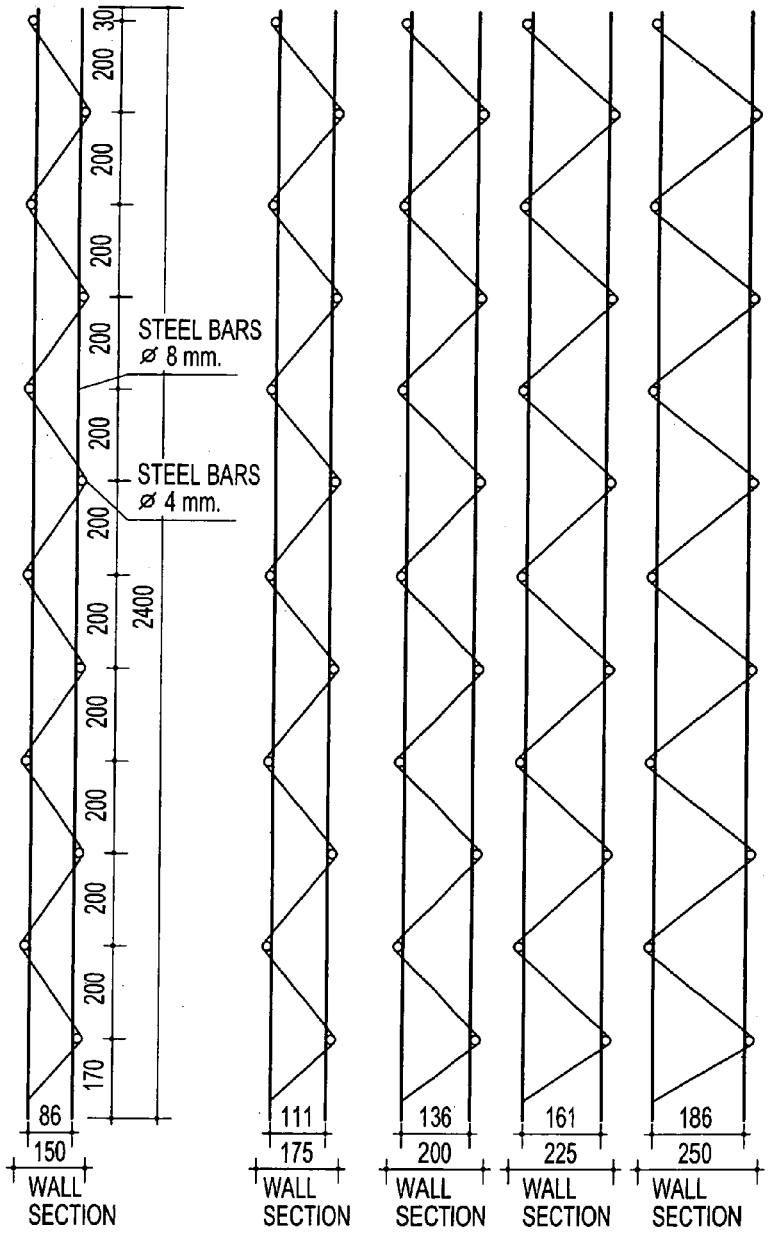
FIG. 45 is a side view corresponding to a series of vertical prefabricated joists, namely two dimensional welded elements, intended to be used in the building sequence formerly described in FIGS. 7–20.

FIG. 45 is a side view corresponding to a series of vertical prefabricated joists, namely two dimensional welded elements, intended to be used in the building sequence formerly described in FIGS. 7–20. FIG. 45 in Print 20 shows a preferred series of prefabricated vertical reinforcement joists of standard measures for several typical wall sections, intended for the use considered in the building sequence described in FIGS. 7 to 14 and also detailed in FIGS. 38, 39 and in FIG. 40. The joists stiffen the assemblage of reinforcement and molding of a wall in its vertical direction. The stringers of the joists correspond to pairs of the vertical bars that form a typical double curtain reinforcement. These pairs of bars are connected by welded wire webs that form the triangular arrangements needed to structure a rigid lattice, which may result of a continuous wire bent, as shown, in a zigzag pattern that slightly exceeds the margins of the pair of stringers, so as to let openings into which the horizontal straight bars can be introduced and fitted in position in order to complete a double curtain reinforcement. Otherwise, the webs may result of a series of diagonal wire segments, distributed to attain a similar zigzag pattern, with similar triangular configurations formed by the webs welded to the stringers, but with their upper endings passing outside the stringers margins as to form open hooks onto which the horizontal bars of a double curtain reinforcement may be directly laid and fixed in position. These plurality of vertical and horizontal joists are intended as prefabricated parts of the wall's reinforcement framework to be assembled in place, and so, a set of different standard sizes is provided. The preferred dimensions, indicated as examples for common uses, are necessarily coordinated with the distances in the tie-spacer distribution, and, in general, with the dimensions of all the elements that integrate this constructive system.

FIGS. 46–48 are plan views of an injected plastic spacer according to an embodiment of the present invention. FIGS. 46 and 47 are perpendicular views of a specially designed spacer intended preferably for the use considered in i): the building sequence referring to walls with prefabricated reinforcement joists described in FIGS. 7 to 14 and also detailed in FIGS. 38 and 39, in FIG. 40 and in FIG. 41. ii): the building sequence referring to slabs, also with prefabricated reinforcement joists, described in FIGS. 15 to 20, and detailed in FIG. 37. A number of the spacers, in combination with pairs of bolts and washer plates, fasten the reinforcement bars and both faces sheathing assemblage, distributed along the surface of a wall member.

The spacer element is composed by a central body (14*a*) and a pair of terminals (14*b*), all made of an injected plastic material, such as polypropylene or nylon. The central body (14*a*) is in the general form of regular square prism, with two pairs of perpendicular semi-cylindrical slots at each side into which the reinforcement bars are to be pressed and fitted in place, plus two bores at its longitudinal axis, to let bolts in penetrating from each of its opposite sides up to a couple of void cases containing the corresponding pair of nuts, in order to fasten both sides of the wall's mold without crossing through it a continuous tie that would let it perforated when removed, as is customary. Alternatively, threading screws may be driven directly into the spacer's bores, without the need of inserted bolts, to fasten the molding boards. Additionally, the spacer's central body prism may have other cavities to reduce material for economical production.

These spacers units should be produced in a plurality of different sizes, with slots adjusted to the variety of bar diameters commonly in use, and lengths according to different wall sections. The terminals (14*b*) may be made in one piece with the central body, or else be produced as separate parts, with alternative designs, that could be removed after the concrete has hardened, depending on the desired finishing for such wall or slab element. Anyway, the terminals (14*b*) should be provided in several sizes according to the specified reinforcement cover, and also in different forms and colors if meant to remain exposed.

FIG. 48 shows a side view of a bar link of an injected plastic material, such as polypropylene or nylon, in the general form of a regular square prism with a pair of semi-cylindrical slots into which the reinforcement bars are to be pressed and fitted in place, plus an axial bore to let through the tie bolt. These links are intended to be used for fixing in place single perpendicular bars, as shown in FIG. 19, in FIG. 25 and in FIG. 34.

Figure 49:
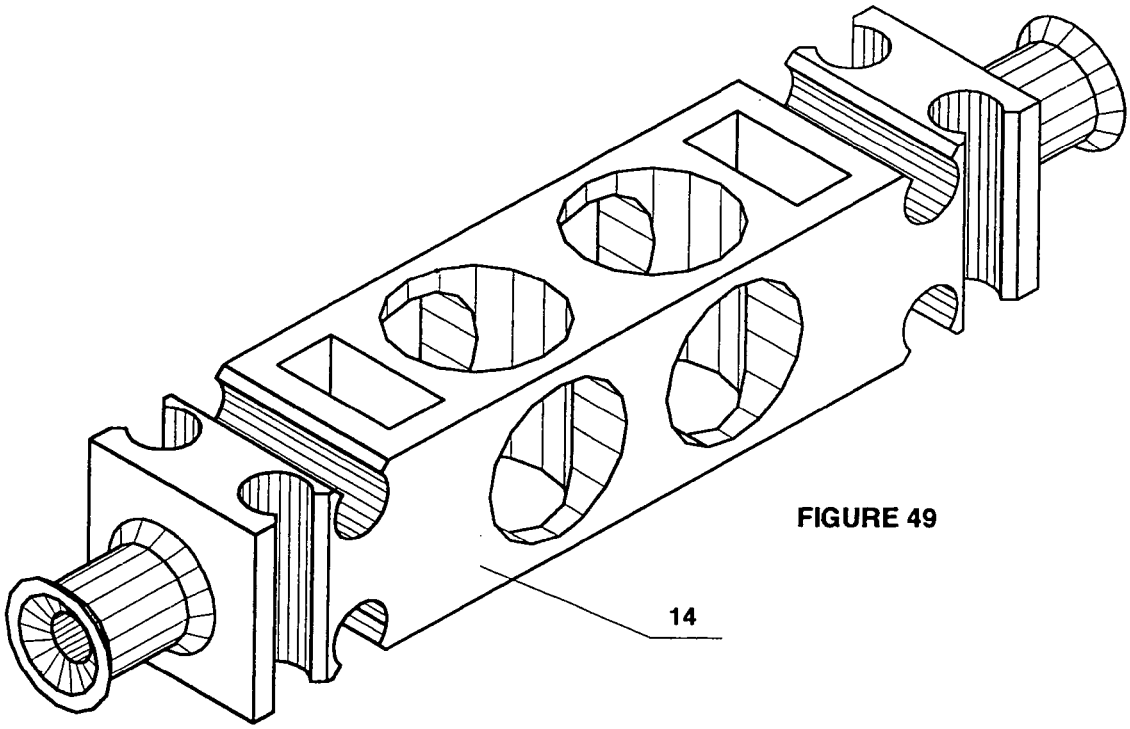
FIG. 49 is an isometric view of an injected plastic spacer according to an embodiment of the present invention.

FIG. 49 is an isometric view of an injected plastic spacer according to an embodiment of the present invention. FIG. 49 is an isometric view of the same spacer (14) already described in FIGS. 47 and 48. FIGS. 50–52 are plan views of an injected plastic sleeve for connecting overlapped bars. The spacer is to be used in the building sequence shown in FIGS. 7–20 and the sleeve is applicable for any of the building sequences of the present invention.

FIGS. 50, 51 correspond to perpendicular side views of a sleeve (2) made of an injected plastic material such as polypropylene or nylon, for connecting overlapped reinforcement bars in proper alignment, as shown in FIG. 1, FIG. 7, and FIG. 21. This element has two parallel bores to be used: i) one open bore, for passing through it the overlapped bar, and the other, closed with a stopper ridge in the middle, for inserting the opposite tip of an extension bar in line with that already set in place, and, ii) passing through the open perforation the extension bar and fitting in the closed perforation the tip of the parallel overlapped bar. These sleeves (2) should be produced in several sizes, with their perforations adjusted to the variety of bar diameters commonly in use. FIG. 52 is an axonometric view of the same sleeve connector (2) already described in FIGS. 50 and 51.

Figure 54:
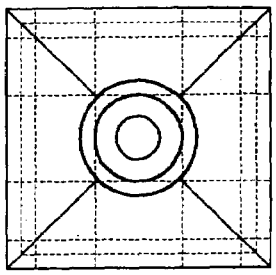

FIGS. 53, 53' and 54 are plan views of an injected plastic spacer and bar connector according to an embodiment of the present invention. The element is to be used in building sequences shown in FIGS. 21–34 to interlock non-welded reinforcement bars and the molding boards together. FIGS. 53 and 54 are perpendicular side views of a specially designed spacer and bar link unit preferably intended for the use considered in the constructive sequence referring to walls with a non-welded rigid bar mat, described in FIGS. 21 to 28, and further detailed in FIG. 42.

Figure 55:
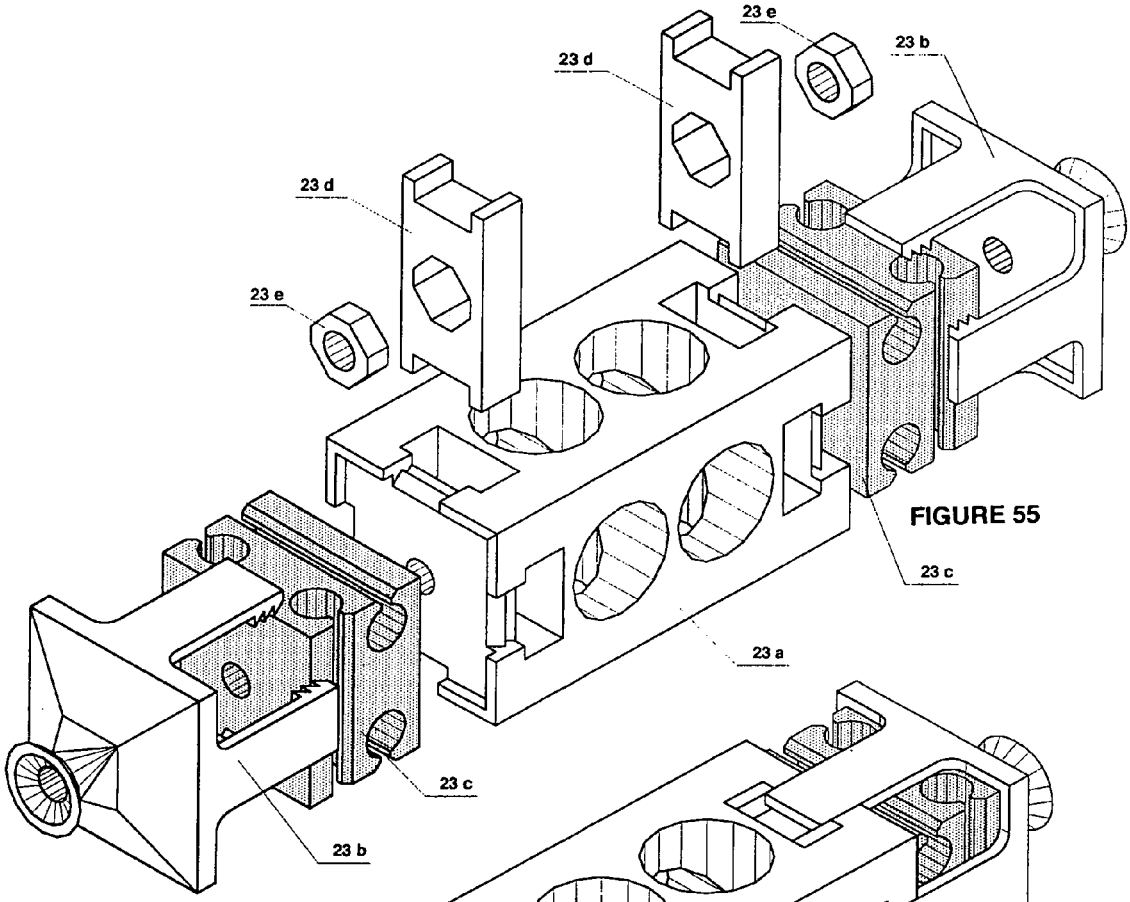
FIGS. 55–56 are axonometric views of separate and assembled parts of an injected plastic spacer and bar connector according to an embodiment of the present invention. The element is to be used in building sequences shown in FIGS. 21–30 to interlock non-welded reinforcement bars and the molding boards together.
Figure 56:
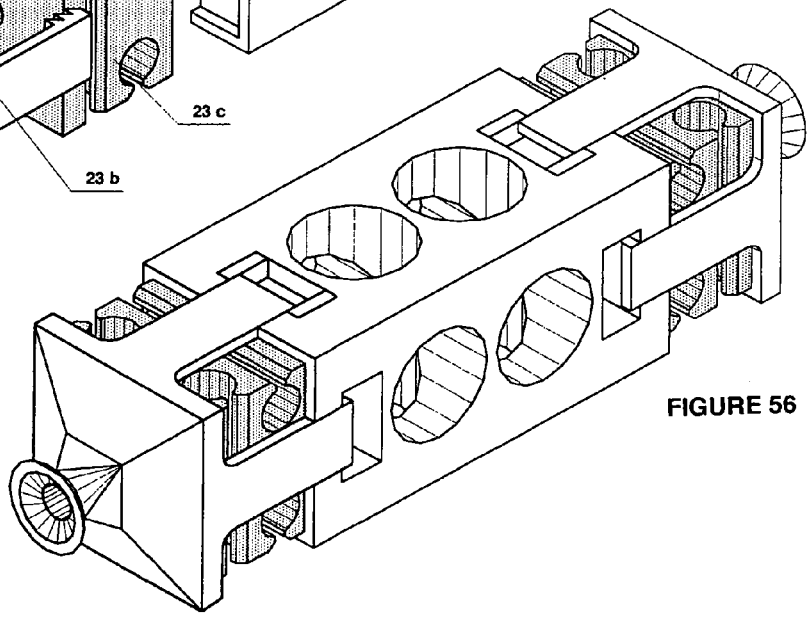

FIGS. 55–56 are axonometric views of separate and assembled parts of an injected plastic spacer and bar connector according to an embodiment of the present invention. The element is to be used in building sequences shown in FIGS. 21–30 to interlock non-welded reinforcement bars and the molding boards together. FIGS. 55 and 56 are axonometric views of the spacer and bar link described in FIGS. 53 and 54. FIG. 55 shows its separate parts, which are a central body (23*a*), a pair of terminals (23*b*), a pair of bar grips (23*c*), and a pair of nut cases (23*d*). FIG. 58 shows these parts assembled.

All of these parts, except for the bar grips and nuts, are to be made of an injected plastic material such as polypropylene or nylon. A number of the spacer units, in combination with pairs of bolts and washer plates fasten the reinforcement bars and both faces sheathing assemblage, distributed along a wall member. The central body (23*a*) is preferably in the general form of a regular square prism, with a border relief at both heads to fit in the bar grip parts (23*b*), and axial bores to let in tie-bolts from each side up to a pair of cavities containing their nut cases, plus several holes made to reduce material for economical production (that may also be practical to install tubes for other facilities, if required). The pair of terminals (23*b*) support the inside face of the molding boards at each side of a wall, in the system's general assembly. They have a central perforation to let through the bolt that ties this assemblage, with a collar protruding from a square pyramidal base against the sheathing, keeping the bolt concealed from direct contact with concrete and enabling its removal for demolding. The pyramidal base has a border relief on the opposite face of the collar to fit in the bar grip part (23*b*), symmetrical to that in the face of the central body (23*a*) already described, and four lateral extensions with saw-teeth notches to snap on the matching dented surface of the central body (23*a*), in order to hold in place the bar grip part (23*b*) in the meanwhile the bolts (11) are screwed in during the assembly process.

The bar grip inserts (23*c*) have a form contained in a regular square prism, with two pairs of perpendicular semi-cylindrical slots at each side into which the reinforcement bars are to be fitted in, and central perforations to let through the bolts (11) that tie the whole spacer unit and sheathing assembly. When the tie-bolts (11) are tightened, the bars set in the inserts get compressed and firmly griped, as to attain a rigid reinforcement cage. These bar grips inserts (23*c*) are to be made of a soft plastic material such as neoprene, or preferably, of a soft plastic material capable of hardening through chemical reaction after the reinforcement bars are set in place. The nut cases (23*d*), that are to be adjusted into cavities in the spacers central body (23*a*), are designed to set in place standard nuts (23*e*) matching the tie-bolts threads, as well as protecting them from the placed concrete. These spacer units (23) should be produced in several sizes, with their slots in their grip inserts (23*c*) adjusted to the variety of bar diameters commonly in use, and their lengths according to different wall sections.

FIG. 53' is a view of similar alternative of the former spacer in FIG. 53, to be used in the slab building sequence described in FIGS. 29 to 34 and detailed in FIG. 43, in which the bolts can be tightened only from the upper side, and, thus, a single bolt that crosses it is to be used, instead of the pair considered before for the case of building sequences of walls. The spacer (26) is formed by a central body (26*a*), a lower terminal (26*b*), an upper terminal (26*d*) and a pair of bar grips (26*c*). The lower terminal is identical to the terminals "23*b*", and the pair of bar grips (26*c*) are the same named "23*c*" of the spacer "23" described above. The central body (26*a*) is a cylinder that lets through a tie-bolt (11), with a pair of square plates at each end equal to the heads of the central body "23*a*" described above, to fit in the same bar grip parts (26*c*) as well. The upper terminal (26*d*) has a similar base to fit the bar grip parts and a case with a snapped-in removable cap to conceal the nut that secures the tie-bolt (11') from the concrete, located leveled with required superior slab surface. Also, these spacer units (26) should be produced in several sizes, with their slots in their grip inserts (26*c*) adjusted to the variety of bar diameters commonly in use, and their lengths according to different slab sections.

FIGS. 57–58 are plan views of an injected plastic conic washer plate according to an embodiment of the present invention. FIGS. 57 and 58 are views of a washer plate (6), preferably made of injected plastic material, or else casted in metal, in the general form of a flat cone with a central perforation, intended as a device to distribute the punctual stress of the tie bolts on the standard ¾" thick plywood or similar molding boards. It is considered in all the building sequences illustrated in assemblages detailed in FIGS. 35, 36, 37, 38, 39, 40, 41, 42 and 43. FIG. 57 shows a side view and a section of symmetrical halves and FIG. 58 shows front and rear in symmetrical halves. The washer plates have a groove in their perimeter to allow fixing in place tensioned straps, for the purpose of tightening joints of molding boards, and border notches plus a relief in their rear face, designed to admit adjusted the tips of additional metallic braces in L shape if local extra stiffness in the formwork is required locally. They also have other cavities for reducing weight without loosing strength. Small cylindrical protrusions extending the central bores at their back face are intended to be inserted in the perforations of the panels, to make connections capable of carrying the shear stress caused by the tensioned straps belted around them, in order to press the edges between the molding panels on parallel planes. The washers may be produced in several sizes according to the stiffness of the molding panels used, the distance between ties and the local pressure caused on them by the placed concrete.

FIGS. 59–62 are side views corresponding to sections showing alternative joint seal strips installed in between molding panel edges to prevent leakage of the forms according to an embodiment of the present invention. FIGS. 59, 60, 61 and 62 are sections of alternative molding panel joints with continues seal strips made of an extruded plastic material, fitted as gaskets between the panel's edges and pressed by the tensioned straps (8) belted around the washer plates (6), to prevent leakage of the forms, as it has been formerly described with reference to FIGS. 3, 4, 13, 14, 27, 28 and 39.

Figure 59:
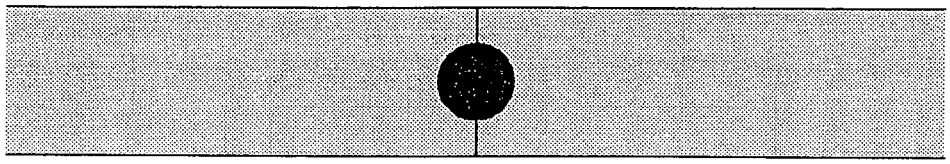
FIGS. 59–62 are side views corresponding to sections showing alternative joint seal strips installed in between molding panel edges to prevent leakage of the forms according to an embodiment of the present invention.
Figure 60:
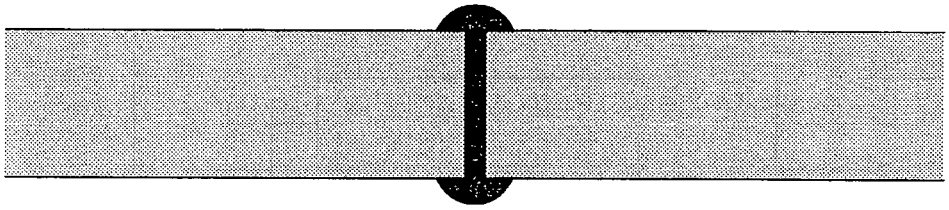

FIG. 59 shows a cylindrical strip of compressible material (as rubber or neoprene) inserted in a chamber let by the halves of semi-cylindrical grooves made in the edges of standard plywood or similar boards with a router machine. This solution leaves the minimum linear mark on the finished surface of the concrete element. FIG. 60 shows a plastic strip with a section that lets in square edges of standard plywood or similar boards. This solution leaves a small rustication on the finished concrete surface.

Figure 61:
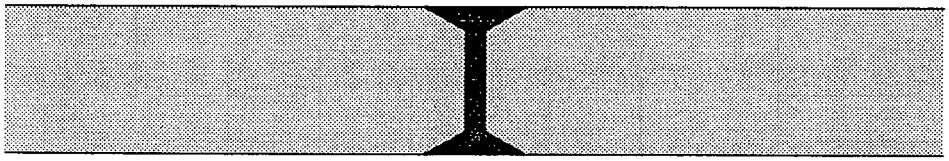
Figure 62:
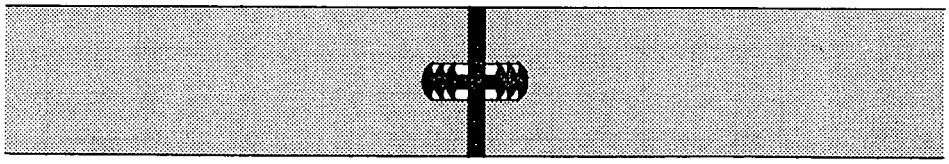

FIG. 61 shows a plastic strip with a section that lets in beveled edges of standard plywood or similar boards. This solution leaves two slight linear marks with no relief on the finished concrete element. FIG. 62 shows a plastic strip inserted in central grooves saw-cut at both faces of the panel edges. This solution leaves small linear marks on the finished concrete element. FIGS. 1–62 have been drawn to scale to show the structural interrelationships between the elements of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A system for reinforced concrete construction, said system comprising:

a reinforcement lattice, wherein said reinforcement lattice includes a plurality of reinforcement bars;

at least one removable form;

at least one of said reinforcement bars of said reinforcement lattice interlocking with the at least one removable form, the system being a rigid assemblage capable of supporting the reinforcement and said at least one removable form in place, as well as resisting a pressure of a poured-in-place concrete on the at least one removable form and maintaining a precise alignment, all said reinforcement bars remaining embedded in said concrete to act together with the concrete in resisting forces.

2. The system according to claim 1, said reinforcement lattice and said at least one removable form forming the rigid assemblage for a building member of cast-in-place concrete construction.

3. The system according to claim 2, wherein said reinforcement lattice is a building member that forms at least one of a wall, column, beam or slab.

4. The system according to claim 2, said reinforcement lattice including a three-dimensional rigid reinforcement cage and a plurality of molding boards being attached thereto substantially in the form of said building member.

5. The system according to claim 2, said reinforcement lattice including a plurality of substantially two-dimensional rigid reinforcement lattice joists; and a plurality of molding boards being attached to the reinforcement lattice in the form of said building member.

6. A system for reinforced concrete construction, said system comprising:

a reinforcement;

at least one form;

said reinforcement interlocking with the at least one form, the system being capable of supporting the reinforcement in place, as well as resisting a pressure of a poured-in-place concrete on the forms and maintaining a precise alignment, wherein said reinforcement and said at least one form form a rigid assemblage for a building member of cast-in-place concrete construction and said reinforcement includes a plurality of rigid reinforcement bars, a plurality of molding boards, and a plurality of sleeves, said sleeves including parallel bores for receiving said bars and forming a rigid reinforcement framework assembled with said molding boards; and at least one tie-spacer device, said tie-spacer device having a plurality of recesses for receiving said reinforcement bars and interlocking said molding boards and said reinforcement bars.

7. A system for reinforced concrete construction, said system comprising:

a reinforcement lattice, wherein said reinforcement lattice includes a plurality of reinforcement bars;

at least one form;

said reinforcement lattice interlocking with the at least one form, the system being a rigid assemblage capable of supporting the reinforcement in place, as well as resisting a pressure of a poured-in-place concrete on the at least one form and maintaining a precise alignment, said reinforcement bars remaining embedded in said concrete to act together with the concrete in resisting forces;

a link device having a plurality of recesses; and a plurality of perpendicular or parallel-overlapped bars, wherein said perpendicular or parallel-overlapped bars are press-fitted into the recesses of said link device.

8. A system for reinforced concrete construction, said system comprising:

a reinforcement lattice, wherein said reinforcement lattice includes a plurality of reinforcement bars;

at least one form;

said reinforcement lattice interlocking with the at least one form, the system being a rigid assemblage capable of supporting the reinforcement in place, as well as resisting a pressure of a poured-in-place concrete on the at least one form and maintaining a precise alignment, said reinforcement bars remaining embedded in said concrete to act together with the concrete in resisting forces;

a plurality of overlapped reinforcement bars; and at least one sleeve being provided for fixing in place said overlapped bars, said at least one sleeve including two parallel bores for receiving the bars.

9. A system for reinforced concrete construction, said system comprising:

a reinforcement lattice comprising a plurality of reinforcement elements;

at least one removable form; said reinforcement interlocking with the at least one removable form, the system being capable of supporting the reinforcement and said at least one removable form in place, as well as resisting a pressure of a poured-in-place concrete on the at least one removable form and maintaining a precise alignment; and said reinforcement and said at least one form forming a rigid assemblage for a building member of cast-in-place concrete construction, all said reinforcement elements remaining within concrete placed in said rigid assemblage upon removal of said at least one removable form;

at least one washer plate device being secured to said reinforcement;

a plurality of molding boards having a plurality of joints therebetween; and a plurality of fasteners, said fasteners securing said washer plates against movement in a direction parallel to a surface of said molding boards and tightening the joints between molding boards arranged in a side-by-side arrangement.

10. The system according to claim 9, further comprising a plurality of ties within said reinforcement, said ties resisting stress caused by a pressure of the placed concrete on the plurality of molding boards.

11. A system for reinforced concrete construction, said system comprising:

a reinforcement;

at least one form; said reinforcement interlocking with the at least one form, the system being capable of supporting the reinforcement in place, as well as resisting a pressure of a poured-in-place concrete on the at least one form and maintaining a precise alignment; and said reinforcement and said at least one form forming a rigid assemblage for a building member of cast-in-place concrete construction at least one washer plate device;

a plurality of molding boards having a plurality of joints therebetween;

a plurality of fasteners, said fasteners securing said washer plates with respect to a parallel direction of a mold surface of said molding boards and tightening the joints between the molding boards; and a bulkhead panel for walls having a board with a pair of grooves into which edges of the molding boards are capable of being inserted, and lateral notches to retain said fasteners fixed to the molding boards and belted to the at least one washer plate device.

12. A system for reinforced concrete construction, said system comprising:

a reinforcement;

at least one form; said reinforcement interlocking with the at least one form, the system being capable of supporting the reinforcement in place, as well as resisting a pressure of a poured-in-place concrete on the at least one form and maintaining a precise alignment; and said reinforcement and said at least one form forming a rigid assemblage for a building member of cast-in-place concrete construction at least one washer plate device;

a plurality of molding boards having a plurality of joints therebetween;

a plurality of fasteners, said fasteners securing said washer plates with respect to a parallel direction of a mold surface of said molding boards and tightening the joints between the molding boards; and a series of alternative continuous joint seal strips for preventing form leakage, said seal strips being installed as gaskets between edges of said joints of said molding boards by said fasteners belted around the at least one washer plate.

13. A method of reinforced concrete construction, said method comprising:

assembling a reinforcement lattice for a concrete structure and at least one removable form for the concrete structure, wherein said reinforcement lattice includes a plurality of reinforcement bars;

forming a rigid assemblage, said assemblage including at least one of said reinforcement bars of said reinforcement lattice interlocking with the at least one removable form, the rigid assemblage being capable of supporting the reinforcement lattice and said form in place;

pouring cast-in-place concrete into said assemblage, said assemblage resisting a pressure of the poured concrete on the at least one removable form and maintaining a precise alignment of a desired building member;

removing said at least one removable form subsequent to pouring of the concrete;

all said reinforcement bars remaining embedded in said concrete to act together with the concrete in resisting forces.

14. The method according to claim 13, wherein said desired building member is at least one of a wall, column, beam or slabs.

* * * * *